US012781506B2

(12) United States Patent
Bonerb

(10) Patent No.: US 12,781,506 B2
(45) **Date of Patent: *Nov. 3, 2026**

(54) SELF-CLEANING GUTTER AND ROOF SYSTEM

(71) Applicant: Tim Bonerb, Rye Beach, NH (US)

(72) Inventor: Tim Bonerb, Rye Beach, NH (US)

( * ) Notice: Subject to any disclaimer, the term of this patent is extended or adjusted under 35 U.S.C. 154(b) by 0 days.

This patent is subject to a terminal disclaimer.

(21) Appl. No.: 19/540,099

(22) Filed: Feb. 13, 2026

(65) Prior Publication Data

US 2026/0176876 A1 Jun. 25, 2026

Related U.S. Application Data

(63) Continuation-in-part of application No. 19/065,283, filed on Feb. 27, 2025, now Pat. No. 12,577,783.

(60) Provisional application No. 63/728,430, filed on Dec. 5, 2024.

(51) Int. Cl.
*E04D 13/064* (2006.01)
*E04D 13/072* (2006.01)
*E04D 13/076* (2006.01)

(52) U.S. Cl.
CPC ..... *E04D 13/064* (2013.01); *E04D 13/0725* (2013.01); *E04D 13/076* (2013.01); *E04D 13/0765* (2013.01)

(58) Field of Classification Search
CPC . E04D 13/076; E04D 13/064; E04D 13/0765; E04D 13/0762
See application file for complete search history.

(56) References Cited

U.S. PATENT DOCUMENTS

| | | | | |
|---|---|---|---|---|
| 5,746,027 | A | 5/1998 | Bonerb | |
| 5,989,357 | A | 11/1999 | Vilhauer, Jr. et al. | |
| 6,668,491 | B1 | 12/2003 | Bonerb | |
| 12,577,783 | B1 * | 3/2026 | Bonerb | E04D 13/064 |
| 2005/0204641 | A1 * | 9/2005 | Collister | E04D 13/076 52/11 |
| 2019/0017274 | A1 | 1/2019 | Song | |

FOREIGN PATENT DOCUMENTS

| | | | |
|---|---|---|---|
| CA | 2328678 | A1 | 3/2001 |
| DE | 20304221 | U1 | 8/2004 |
| EP | 0903449 | A2 | 3/1999 |
| WO | 1998039534 | A2 | 9/1998 |

* cited by examiner

*Primary Examiner* — Babajide A Demuren

(57) ABSTRACT

A self-cleaning gutter system for controllably removing gutter contents from a roof at a time determined by an operator having a gutter frame attachable to the roof, an inflatable inflate membrane attachable to the roof, and a flexible cover attachable at a first end to the roof uphill from the gutter frame and sized to cover the inflate membrane in both a deflated and inflated state and at least a portion of the gutter frame, whereby the inflate membrane in the deflated state causes gutter contents to be controllably retained on the roof by the gutter frame, and the inflate membrane in the inflated state causes the gutter contents to be controllably lifted upward and over an edge of the gutter frame, thereby controllably removing gutter contents from the roof.

26 Claims, 31 Drawing Sheets

SELF-CLEANING GUTTER AND ROOF SYSTEM

CROSS-REFERENCE TO RELATED APPLICATIONS AND PRIORITY

This application is a continuation-in-part of prior Application No. Ser. No. 19/065,283, filed Feb. 27, 2025, which is herein incorporated by reference in its entirety.

BACKGROUND

1. Field of Invention

This invention relates to improvements for making, selling, distributing, installing and using a flexible cover over an inflatable membrane arrangement for controllably removing ice, snow, leaves and other debris from gutters and roofs on buildings.

2. Description of the Related Art

As many homeowners and businesses struggle with snow build up, ice dams and gutters that can easily fill with leaves and debris, the need for a single removal and protective system is desired. Snow and ice dams fall from roofs without warning, causing grievous injuries to people and enormous damage to property.

One solution to this problem that has been tried is described in U.S. Pat. No. 6,668,491 B1 by Bonerb (the '491 patent), which is not admitted to being prior art by its mention in this Background section. The '491 patent describes a simple apparatus used to break up snow and ice dams. However, the '491 patent does not describe a flexible cover over an inflatable membrane and gutter frame capable of holding a substantial amount of gutter contents in place before being controllably released at a time determined by an operator. While many types of leaf and gutter guards have been available for years as well as the use of heat-tape and other types of heat panels configurations for melting ice dams have been available, there has not been a single system that can do it all with superior and simple operation.

SUMMARY

What is needed, therefore, is a self-cleaning gutter and roof system that satisfies these needs. One object of the invention is to provide a method of removing ice and snow from a roof without using heat and melting.

Another object of the invention is to provide a covering that can move and shake to discharge snow, ice, leaves and other debris.

Another object of the invention is to hold snow and ice on a roof so that it doesn't slide or fall off in an uncontrolled manner and cause damage and/or personal injury.

Another object of the invention is to mount the blower under the covering, or in the attic, to hide the hoses and other air fittings.

Yet another object of the invention is to equip any style of roof surface such as shingled, metal, fiberglass, slate and or tile with the gutter frame and gutter cover assembly.

The above objects are achieved by a self-cleaning gutter system comprising a gutter frame attachable to a roof deck or roof shingles; an inflatable inflate membrane attachable to the roof deck or shingles; a flexible cover attachable at a first end to the roof uphill from the gutter frame and sized to cover the inflate membrane in both a deflated state and an inflated state, and at least a portion of the gutter frame. The inflate membrane in the deflated state causes gutter contents to be controllably retained on the roof by the gutter frame, and the inflate membrane in the inflated state causes the gutter contents to be controllably lifted upward and over an edge of the gutter frame, thereby controllably removing gutter contents from the roof. These and other benefits, features, and advantages will be made clearer in the accompanying description, claims, and drawings.

DETAILED DESCRIPTION OF THE INVENTION

Figure 1:
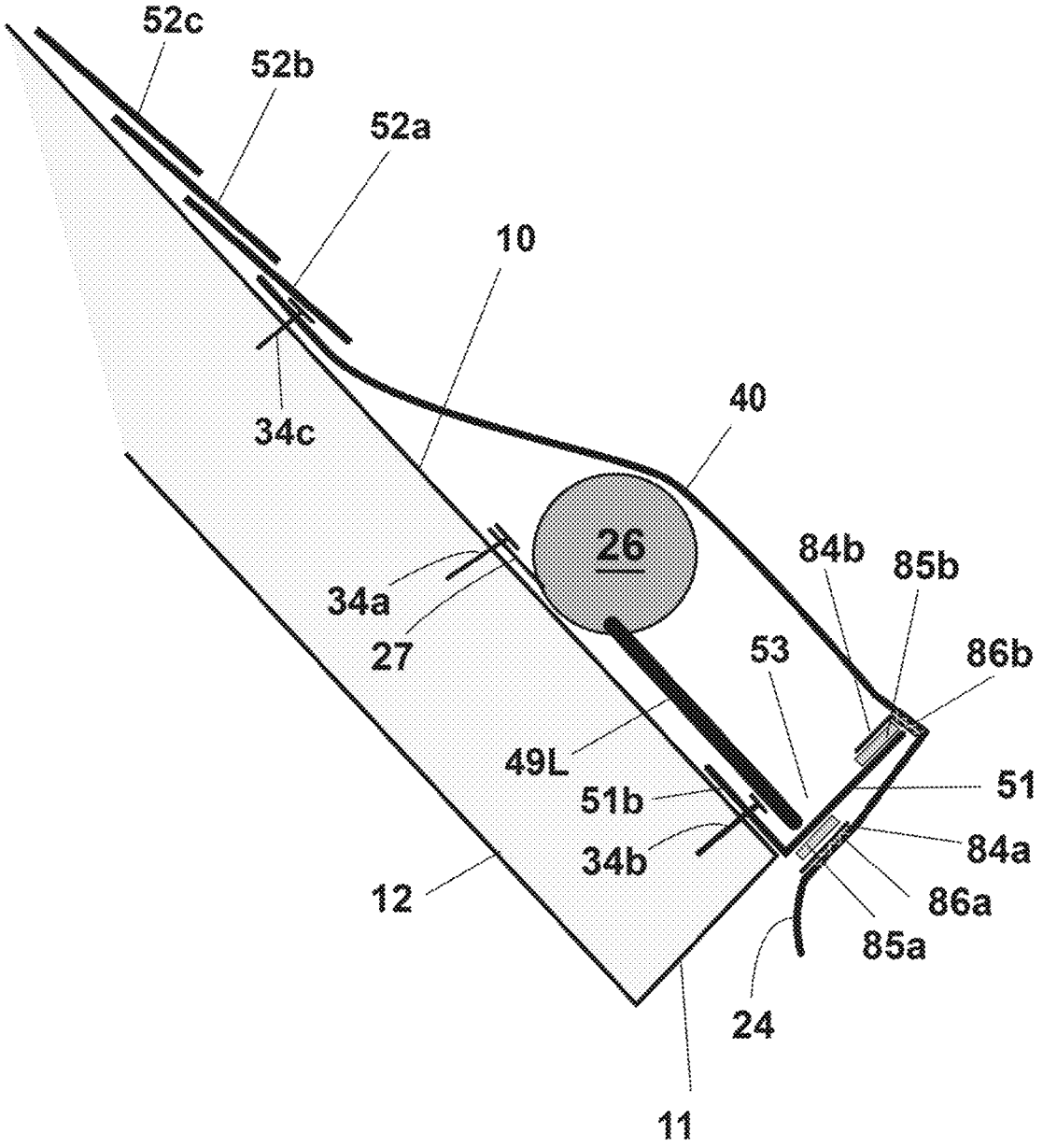
FIG. 1 is an end view of gutter cover fastened to gutter frame via hook & loop fastening strips with gutter frame securely fastened on top of roof with inflate membrane fully inflated. With inflate membrane fully inflated, gutter cover rises above the surface of the roof as well as the top end of gutter frame.

FIG. 1 is a side view of roof 10 equipped an L-shaped gutter frame 51 fastened to lower section of roof 10 directly above eave 11 via gutter frame bottom 51*b* and fastener 34*b*, such as nails or screws. As shown, a strip of 2-inch-wide loop 85*a* is stapled, glued, or otherwise fastened to the bottom outside gutter frame 51, (which can be made of wood, metal or plastic) as well as another strip of 2-inch-wide loop 85*b* is fastened to the top section of gutter frame 51. Loop strip 85*a* will interface and fasten to strip of 2 inch wide hook 84*a* that is fastened to the inside surface of gutter cover 40 via stitch 86*a* as well as a 2 inch wide strip of hook 84*b* attached to the underside of gutter cover 40 via stitch 86*b*. Fasteners such as staples, nails, and screws can be used in addition the hook and loop fasteners to hold gutter cover 40 in place or without the use of hook and loop fastener. Also, notice bottom end of gutter cover 24 functions as a drip edge to keep water, snow and ice off of eave 11. It is important gutter cover 40 becomes taught as inflate membrane 26 is fully inflated so that any snow, ice, leaves, water and other debris on top of gutter cover in the area of gutter trough 53 rises above gutter frame 51 so it can flow off roof 10. With top end of gutter cover 40 fastened to roof 10 with fastener 34*c* under shingle 52*a* ensures gutter cover 40 will become taught as the bottom portion of gutter cover 40 is securely fastened to gutter frame 51 via hook 84 and loop 85 fasteners. As shown, inflate membrane 26 is equipped with inflate membrane flap 27 which is secured in the correct position and secured to roof 10 via fastener 34*a*. Low pressure air is supplied to inflate membrane 26 via blower line 49L and blower 21 (see FIG. 10). In addition to gutter cover 40 and inflate membrane 26 having the ability remove materials from roof 10 and to hold materials on roof 10 when inflate membrane 26 is deflated allowing gutter cover 40 to lay flat on roof 10, it also provides a high level of waterproofing to the bottom end of a roof 10. Gutter cover 40 with inflate membrane 26 and gutter frame 51 can also be installed on almost any type of roof, including metal, fiberglass, slate and tile roofs. When inflate membrane 26 is completely deflated and gutter cover 40 lays flat on roof 10, gutter frame 51 acts as a brake so snow and ice can't suddenly slide off roof 10 and create a hazardous situation.

Figure 2:
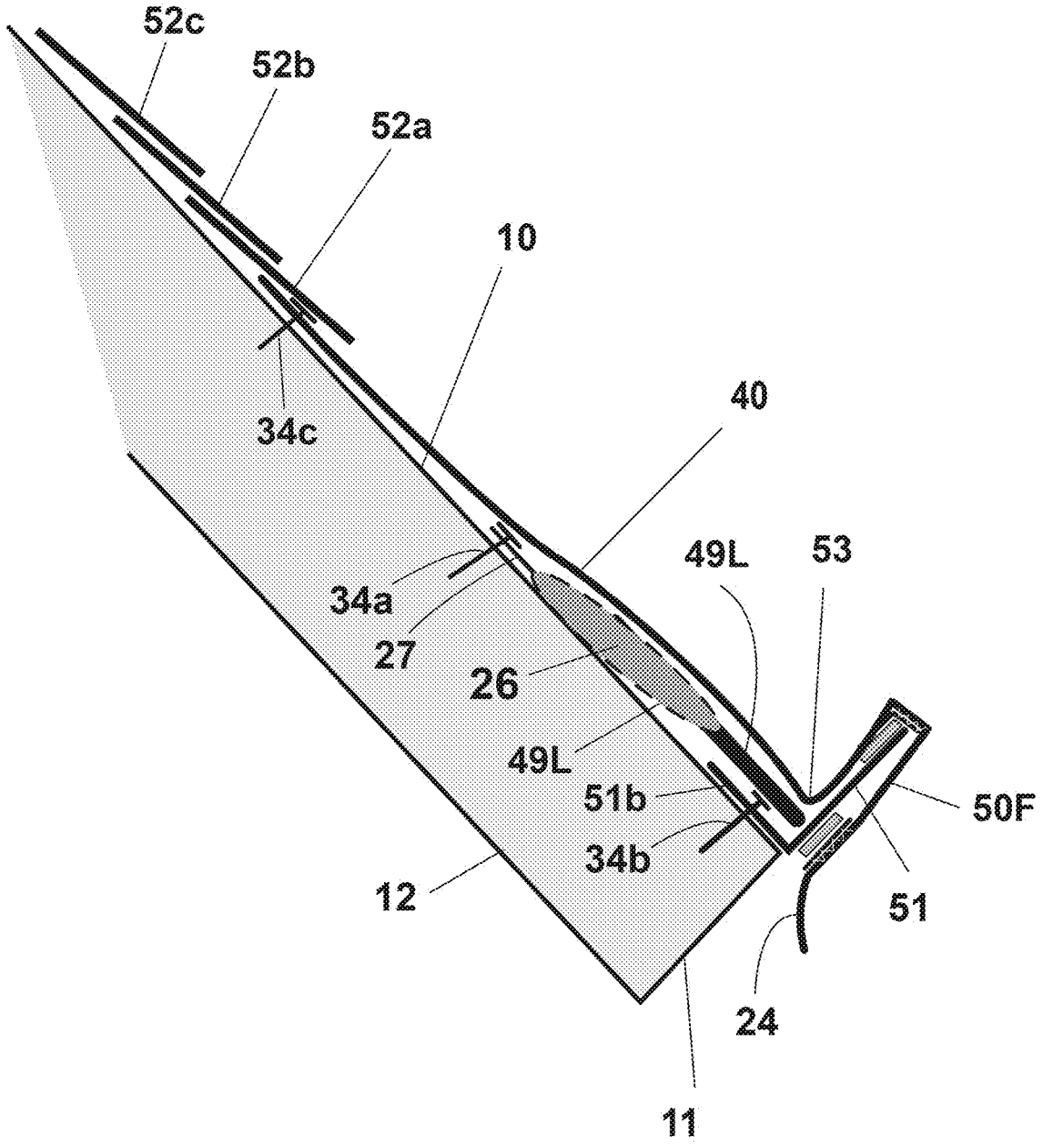
FIG. 2 is a view of gutter cover and gutter frame secured to the roof with inflate membrane fully deflated, allowing a gutter trough to function in handling water flowing down the roof.

FIG. 2 is an end view of a roof eave 11 equipped with gutter cover 41. Gutter cover 40 can be made of a PVC coated, woven polyester fabric from fabric weights between 22 oz. up to 40 ounce which is very strong and durable. Gutter cover 40 may also be provided in reflective colors such as white and silver to reflect the sun's rays and keep the roof and interior of a building much cooler. This benefit would be especially useful and valuable for larger commercial buildings that typically use darker colored roofs such as for dark colored shingles and metal roofs. The energy savings of using a white or silver roof compared to a dark shingled roof or colored metal roof can be significant. Many of these PVC coated woven fabrics have a tensile strength of above 600 lbs./inch. Top end of gutter cover 40 may be fastened to roof 10 under shingle 52*a* with a roof nail, staple, screw or other fastening means. Inflate membrane 26 is connected to roof 10 under gutter cover 40 via inflate membrane flap 27 with fastener 34*a*. In this configuration, gutter frame 51 may be a length of metal, fiberglass, rubber or vinyl angle. When you consider the design of a standard gutter system, which requires a lot of fasteners and brackets that is flimsy at best, and often requires seasonal maintenance and cleaning, the gutter cover 40 assembly is heavy duty as well as more attractive to the viewer with cover face 50F and drip edge 24 covering the eave 11. Because the gutter frame 51 can be sized higher, to accommodate more annual rainfall, downpours and storms, it can handle more water than a standard gutter. Also, because gutter cover 40 rises up over gutter frame 51, it is self-cleaning because it can quickly and easily dump anything in it (leaves, dirt, branches, twigs, ice and snow, etc.) off roof 10 and to the ground in seconds. Gutter cover 40 has a usable life of 20 to 25 years and is very, very strong and reliable, eliminating almost all maintenance issues as compared to a standard gutter system and leaf prevention components such as Leaf-Filter™ and Byers Leaf-Guard™. Also, gutter guards such as Leaf-Filter™ and Byers Leaf Guard™ and others do not remove and ice and snow from a roof, nor do they keep the bottom section of a roof and eave waterproofed. To keep gutter cover maintained and with its top surface in a slippery condition and to extend its life, compounds such as Armor All® and other silicone sprays with RV protection can be applied. It is important to note that when snow 7 and ice buildup on gutter cover 40, all it takes is a slight motion of gutter cover 40 caused by the expansion action of inflate membrane expanding will cause ice and snow 7 to break free form it almost instantly, much like twisting a plastic ice tray to remove the ice cubes. As a safety feature, gutter frame 51 holds back the ice and snow 7 above it on roof 10 so it can't fall or slide off unexpectedly. It is only when gutter cover 40 lifts higher than gutter frame 51 when snow, ice, leaves and other debris can exit roof 11. Ice, snow, leave, and other debris 7 is collectively referred to as "gutter contents" in this description and in the claims. Gutter frame 51 and gutter cover 40 may be installed on shingled, metal, fiberglass, slate and/or tile covered roofs. Heat cable may be used under gutter cover 40 or on top of gutter cover 40 in trough 53 to help melt snow and ice so it can flow off roof 10 in the gutter trough 53.

Figure 3:
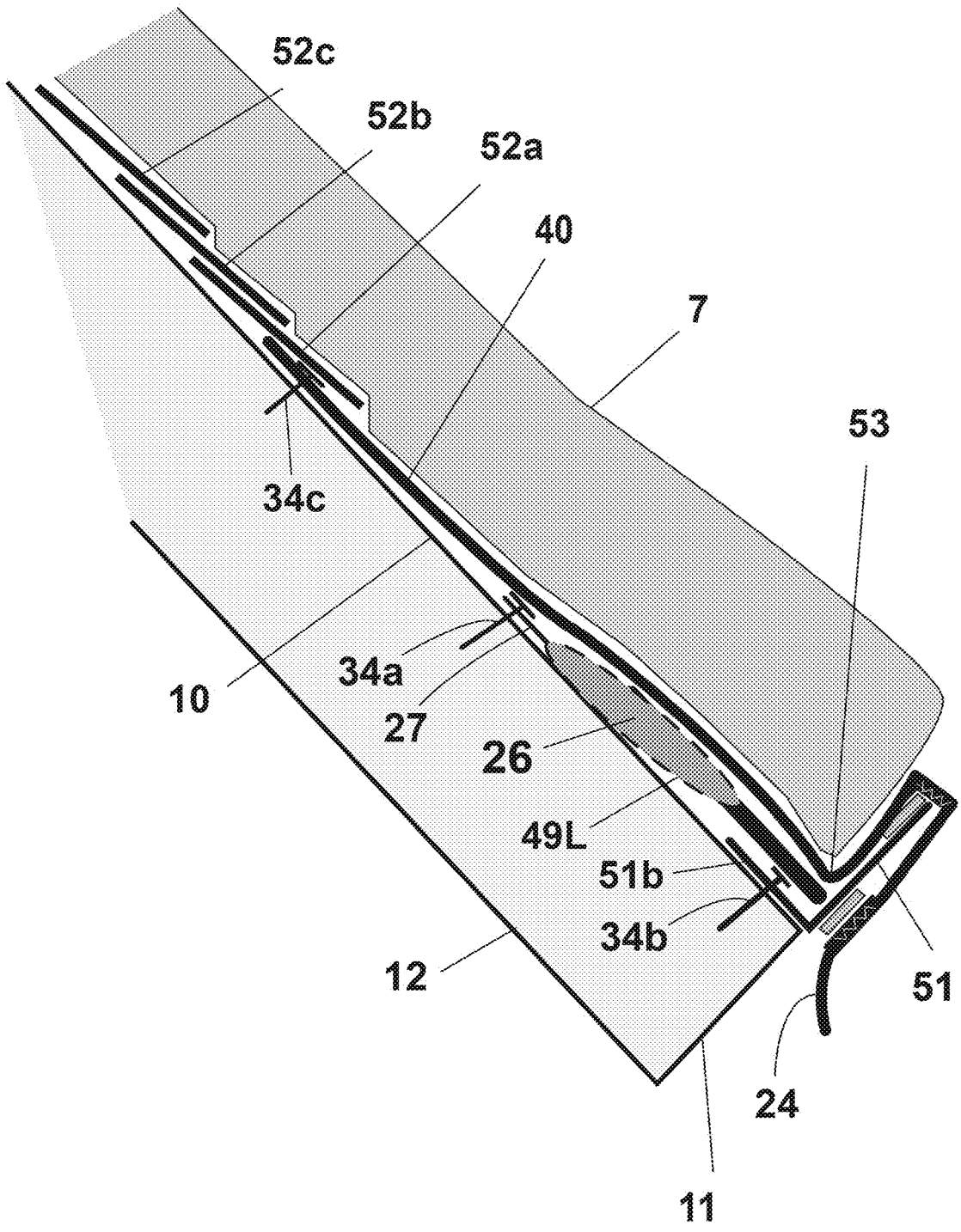
FIG. 3 is an end view of snow resting on gutter cover with inflate membrane deflated with gutter frame holding snow on roof. Gutter frame acts as a brake to prevent snow and ice from sliding off the roof.
Figure 4:
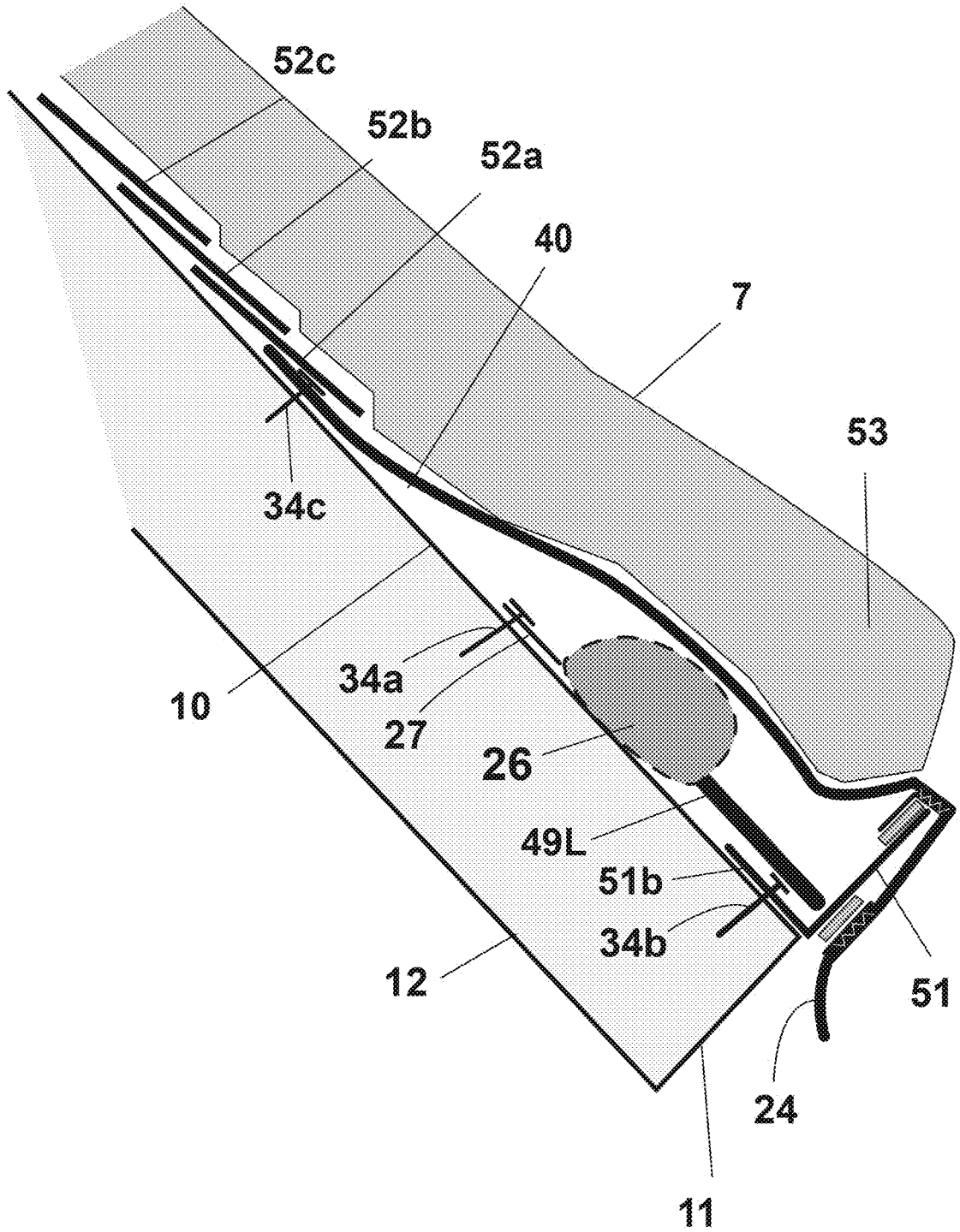
FIG. 4 is an end view of inflate membrane beginning to inflate under gutter cove which causes it to begin lifting upward from the roof while gutter frame continues to function as a partial brake to hold snow on roof.
Figure 5:
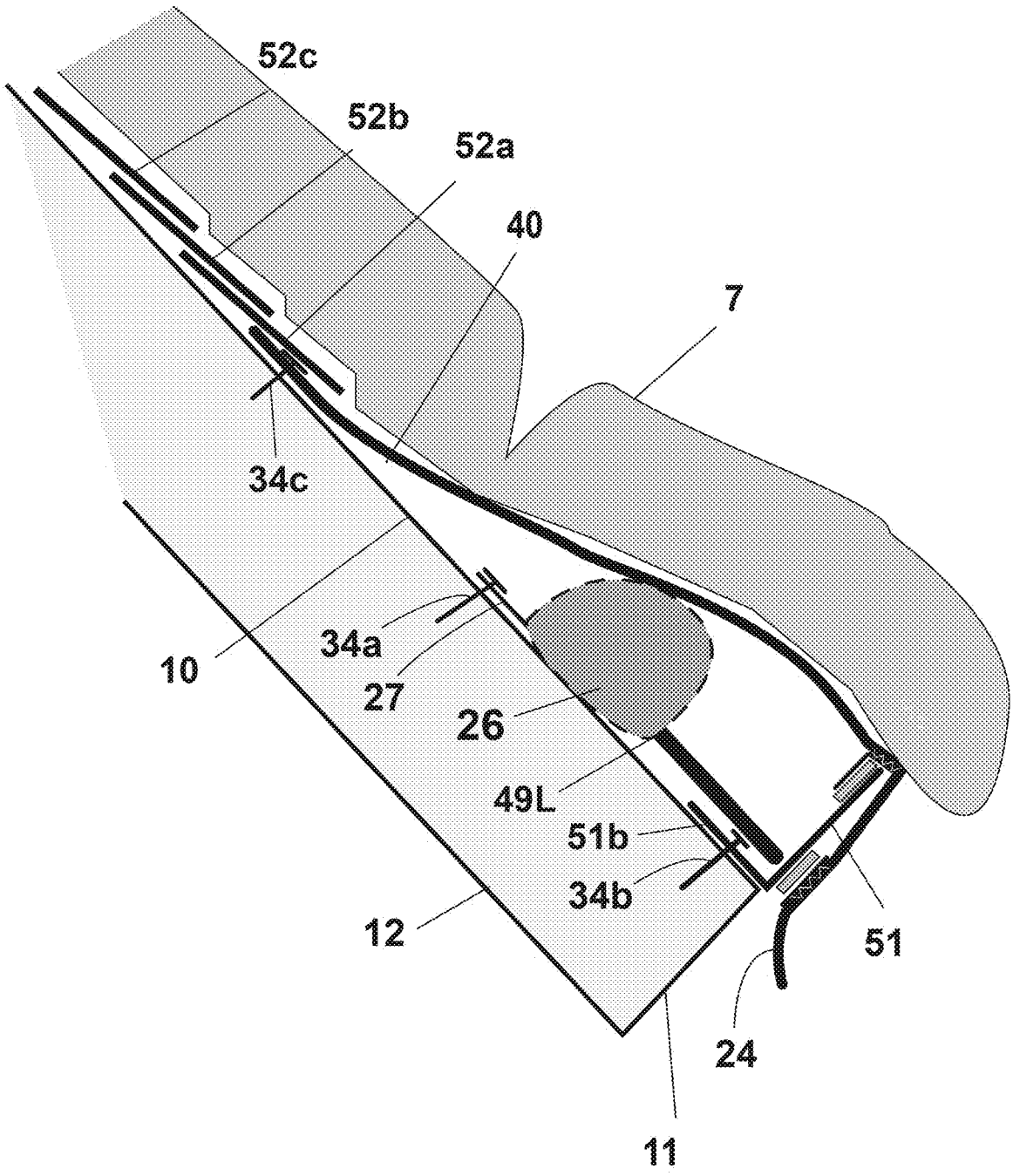
FIG. 5 is an end view of inflate membrane under gutter cover fully inflated which causes the snowpack on the roof to begin splitting into two sections as the weight and mass of the lower accumulation of snow begin to exit roof via gravity.
Figure 6:
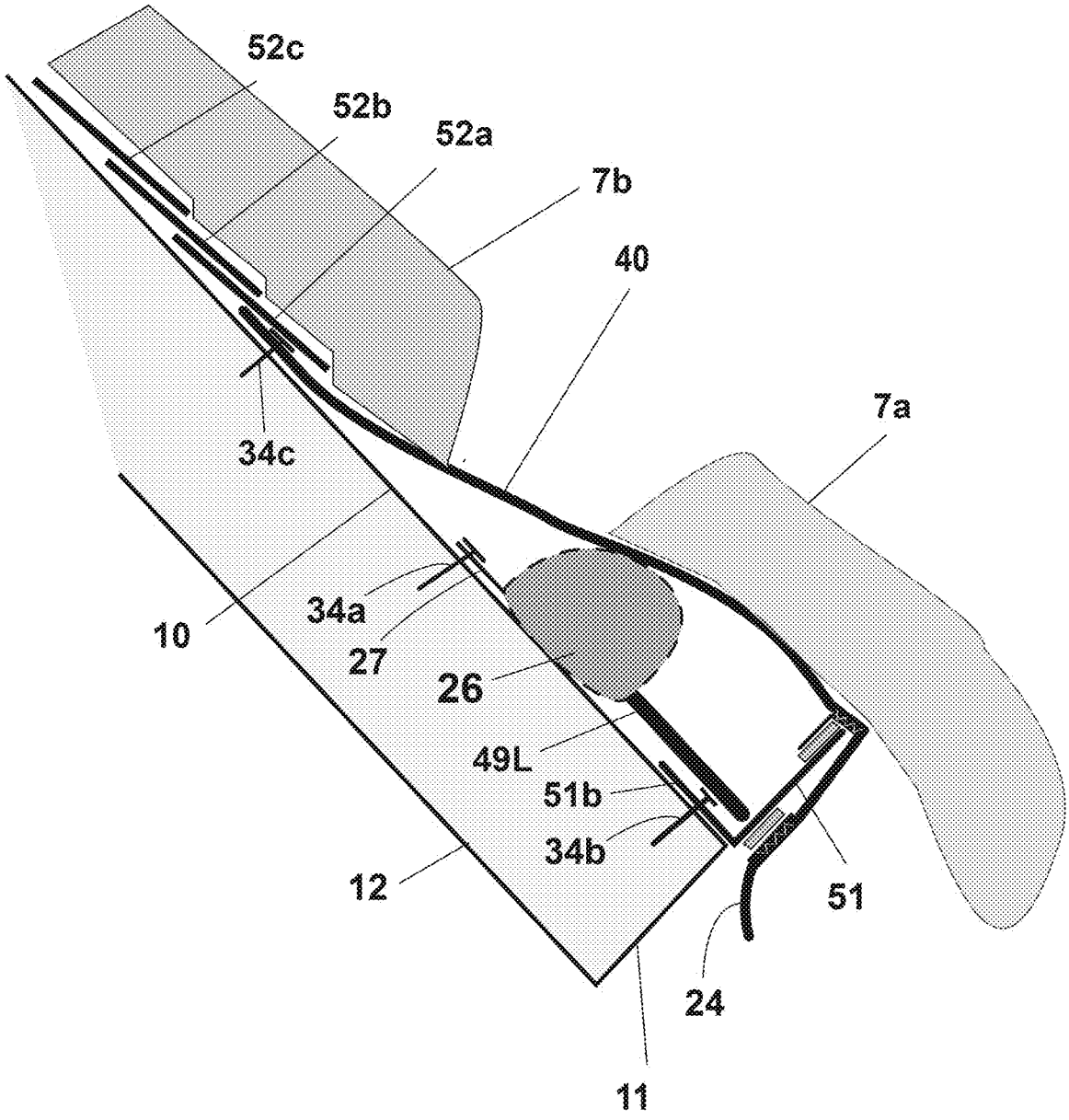
FIG. 6 is an end view of inflate membrane under gutter cover fully inflated which causes the snowpack to split into two sections as the upper accumulation of snow is held on roof via the roof surface of the shingles. Lower snowpack is shown sliding off the roof via the slippery surface of gutter cover.
Figure 7:
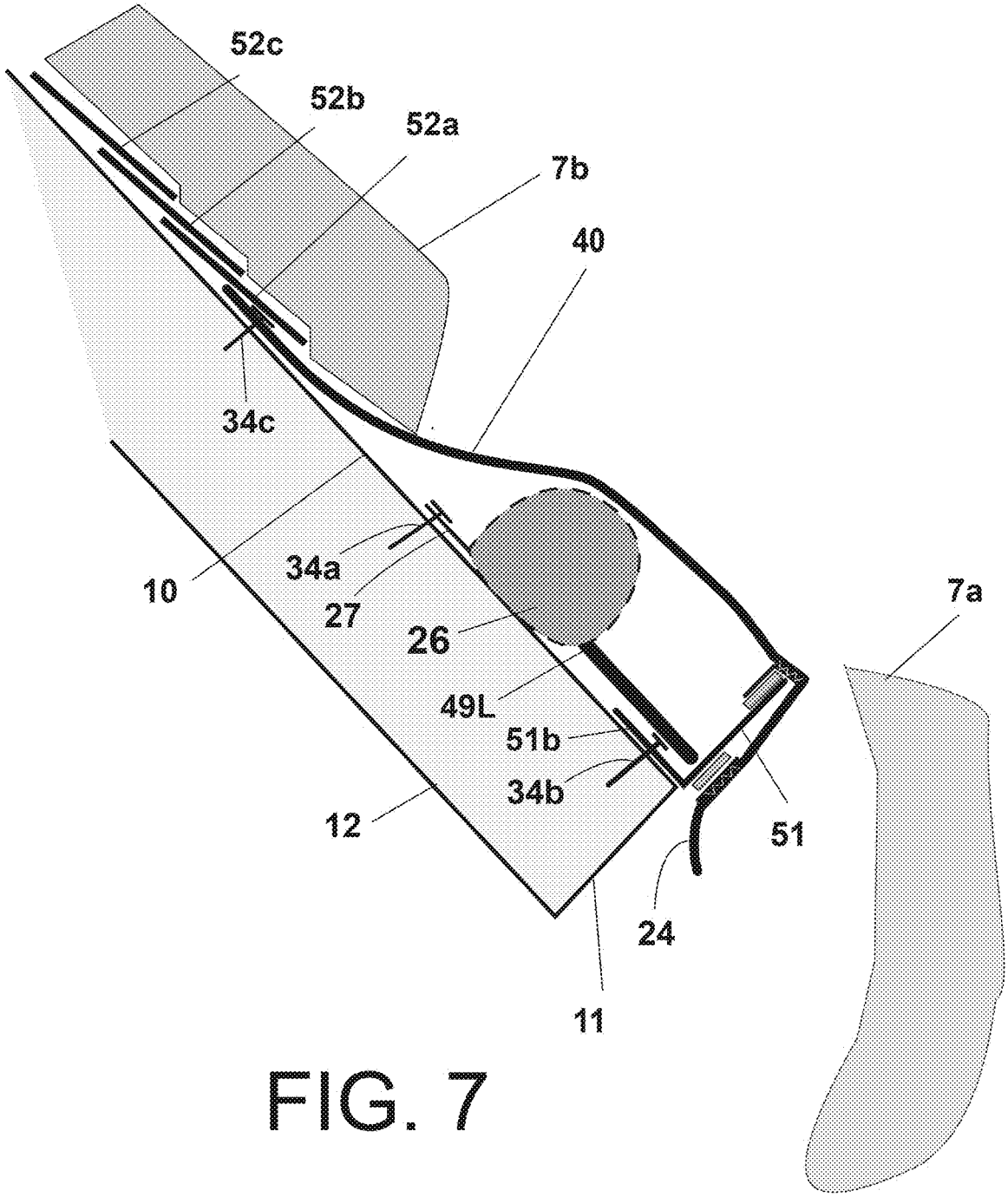
FIG. 7 is an end view of inflate membrane still inflated as lower snowpack of snow and ice falls off the roof via gravity. Lower end of gutter cover functions as a drip edge should any water flow over the top of the gutter frame. Gutter cover completely covers and protects the lower roof and eave from water damage.
Figure 8:
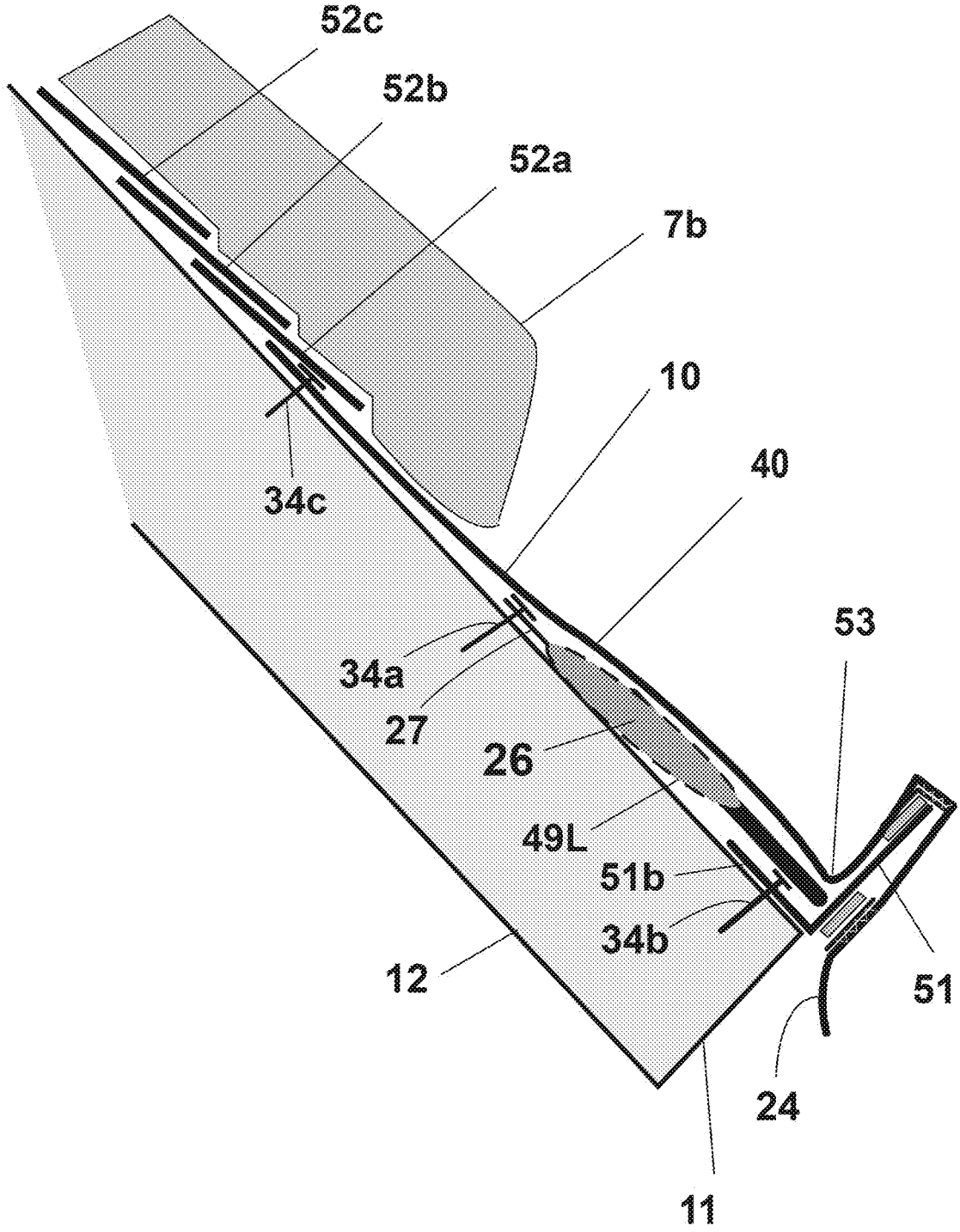
FIG. 8 is an end view of inflate membrane completely deflated allowing gutter cover to lower back down to the roof surface and the gutter trough to take shape again to catch runoff from the upper snowpack on roof.

FIGS. 3, 4, 5, 6, 7 and 8 are sequential sides views of gutter cover 40 rising upward as inflate membrane 26 is inflated to remove snow 7 from roof 10 and moving downward as blower 21 (FIG. 10) is turned off. In FIG. 3, snow 7 has settled and is held on roof 10 on top of gutter cover 40 behind gutter frame 51 which acts as a brake so snow and ice can't slide or fall off roof 10 unexpectedly. Whether used in a residential or commercial setting, gutter frame 51 provides a high level of safety as well as liability protection from falling ice and snow for the building owner. In FIG. 4, as blower 21 is turned on, low-pressure air with a flow rate of about 100 CFM and at a pressure between 1 to 4 PSI flows through blower line 49L into inflate membrane 26. As inflate membrane 26 expands upward as it is inflated, gutter cover 40 lifts upward, but is still held on roof via gutter frame 51 which acts as a brake. Inflate membrane 26 under gutter cover 40 is very powerful—at 2 PSI, which is less than the maximum air pressure output of blower 21, can lift as much as 282 pounds per square foot. This is enough upward force to lift and break up several inches of ice. In FIG. 5, inflate membrane 26 continues to inflate and expand under gutter cover 40 lifting snow 7 slightly higher than gutter frame 51 so that snow 7 can slide off roof 10. In FIG. 6, snowpack 7 is split into two parts, 7*a* and 7*b* as snow 7*b* continues to cling to the rough surface of shingles 52*c*, 52*b* and 52*a* as snow 7*a* slides above gutter frame 51 and off roof 11. In FIG. 7, snow 7*a* is removed from roof 10 as controlled by an operator to make sure the area below is clear and safe. For an added safety feature, blower 21 can be equipped with a sound alarm. In FIG. 8, blower 21 has been turned off allowing inflate membrane to deflate so gutter cover 40 can move downward and lay against roof 10. Notice that as snow 7*b* melts, drain water will be captured in gutter trough 53 and should snow 7*b* slide down roof, its downward motion will be stopped and held in place via gutter frame 51. The average width of gutter cover 40 from the top of gutter frame 51 to the top end where fastener 34*a* is applied is about 30" which is the typical area where ice dams typically form. Not only does gutter cover 40 remove ice, snow 7, leaves and other debris from roof 10, but it also protects the lower roof 10 and eave 11 from water leaks and water damage caused primarily by ice dams. Gutter cover 40 is also a water-proof barrier that protects your lower roof 10 and eave 11 from water damage.

Figure 9:
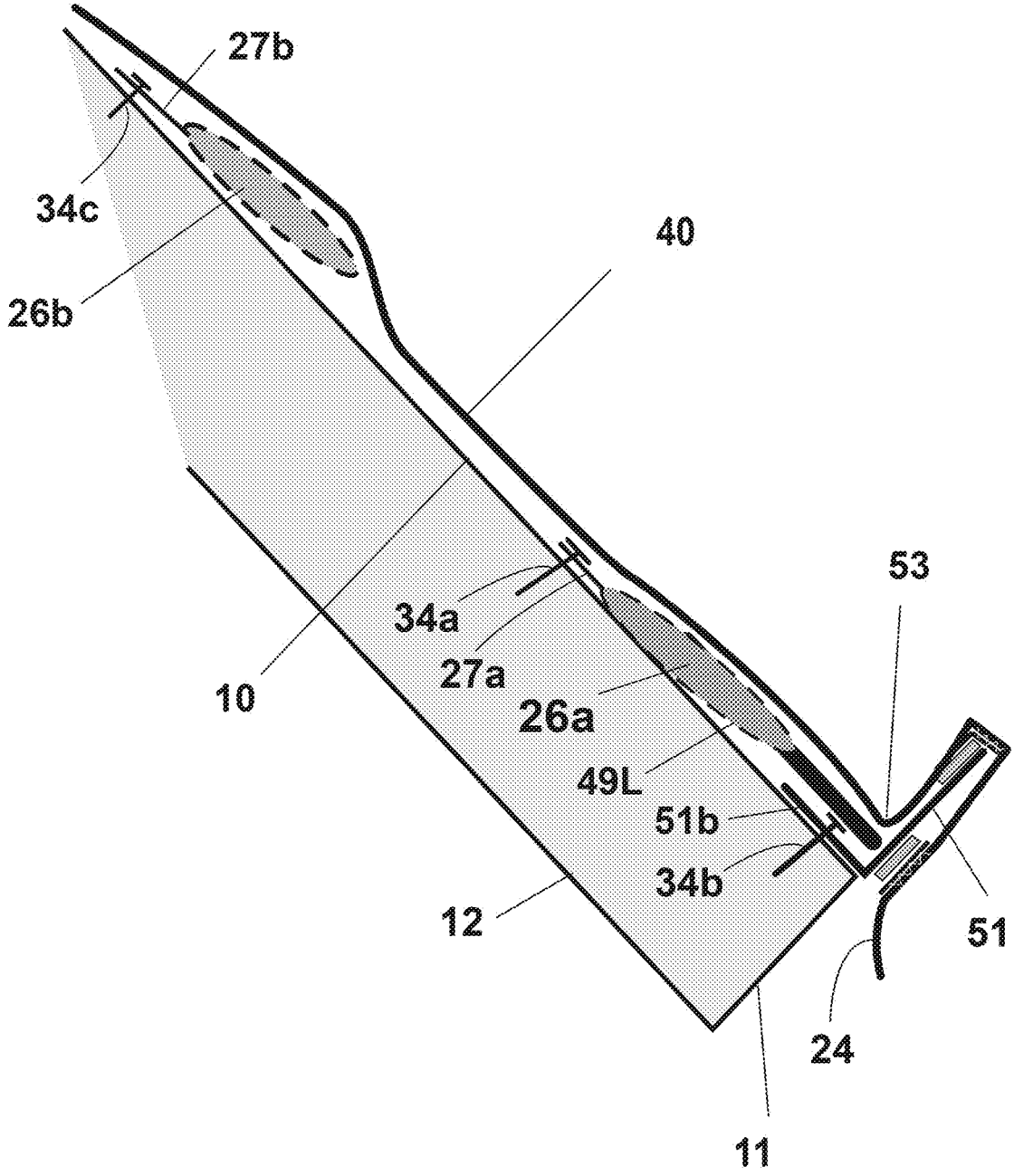
FIG. 9 is an end view of gutter cover extending further of the roof to the roof peak is desired with an additional inflate membrane above the lower one under gutter cover to cause movement to allow snow and ice to break free from the slippery top surface of the gutter cover.

FIG. 9 is an end view of gutter cover 40 extending more than the typical 30" up roof 10 from eave 11 of a building to provide greater coverage and protection from heavy snowfall that could cause excessive weight on roof 10 of a building and subsequent damage. In this configuration, added inflate membrane 26*b* is positioned further up roof 10 under gutter cover 40 to provide added movement and agitation so snow and ice can break free from the surface of gutter cover 40. If desired, gutter cover 40 and multiple inflate membranes 26 may be used on roof 10 from the eave 11 of roof 10 to the peak of roof 10. In this configuration, gutter cover 40 can remove snow 7 from the entire top surface of a section of roof 10.

Figure 10:
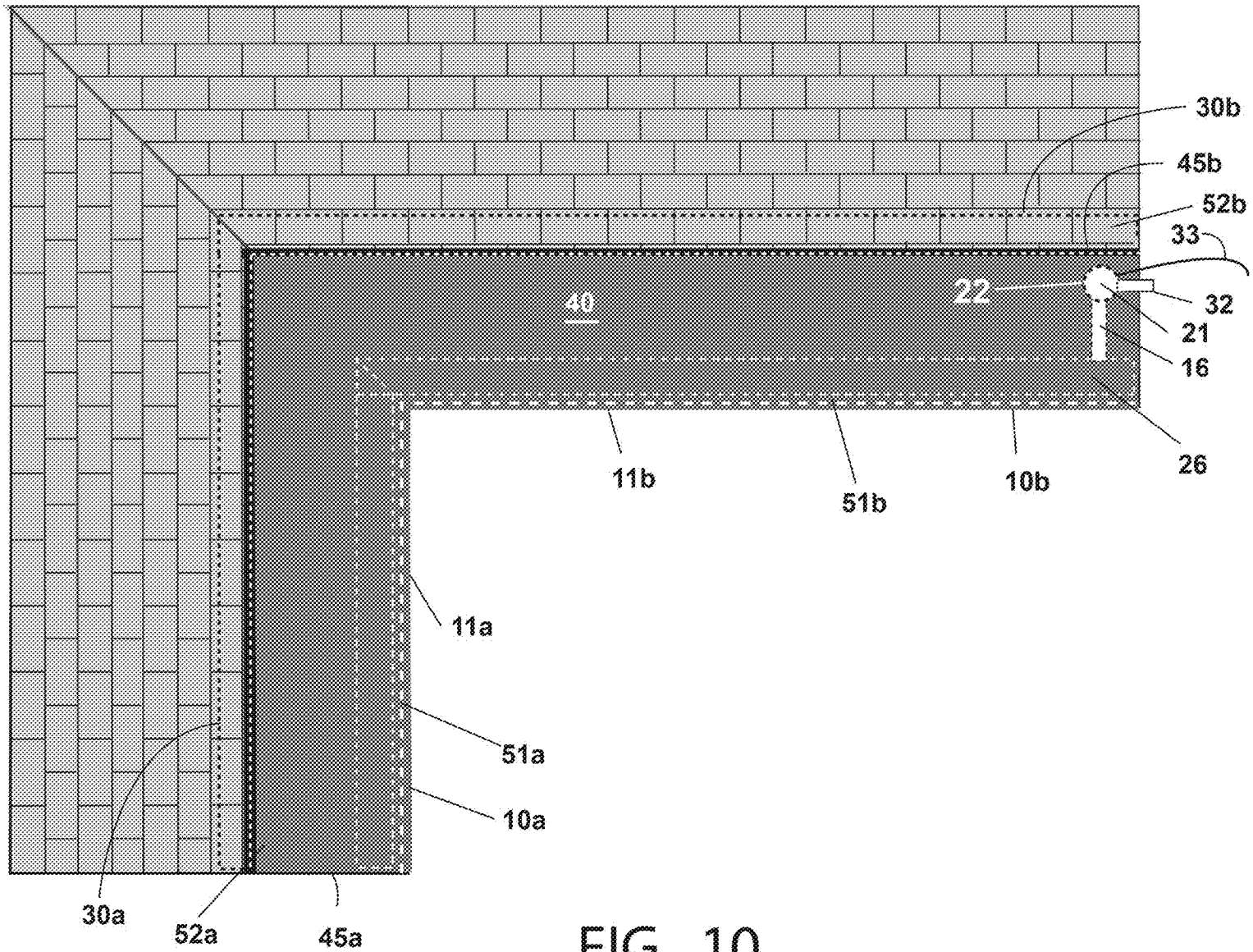
FIG. 10 is a top view of roof with gutter cover installed on the entire surface of the lower roof which includes over a roof valley and around an interior corner of the roof. Also show is blower, air lines and other controls installed under the gutter cover and connected to inflate membranes just above the eave of the roof.

FIG. 10 is a top view showing roof sections 10*a* and 10*b* with blower 21 and blower intake/exhaust 32 fastened to roof 10*b* as well as connected to inflate tube 16. Once blower 21 has been positioned properly and fastened to roof 10*b*, top of gutter cover 40 is attached and secured over blower 21. Also shown is the bottom 69 (FIG. 11) of edge gutter cover 40 extended over gutter frames 51*a* and 51*b* and attached to eaves 11*a* and 11*b*. A separate blower enclosure cover 22 is installed over blower 21 and the other blower components which may be made of the same fabric as gutter cover 40. Blower enclosure cover 22 is secured to gutter cover 40 in a permanent and leak proof manner. Also shown are inflate tube 16 connected to inflate membrane 26 as well as blower intake/exhaust assembly also located under gutter cover 40. Blower 21 can also be located in the attic of a building if desired. While it's possible to locate blower 21 on the roof 10 or fascia board 12, it may be unsightly and subject to the damaging effects of the weather.

Figure 11:
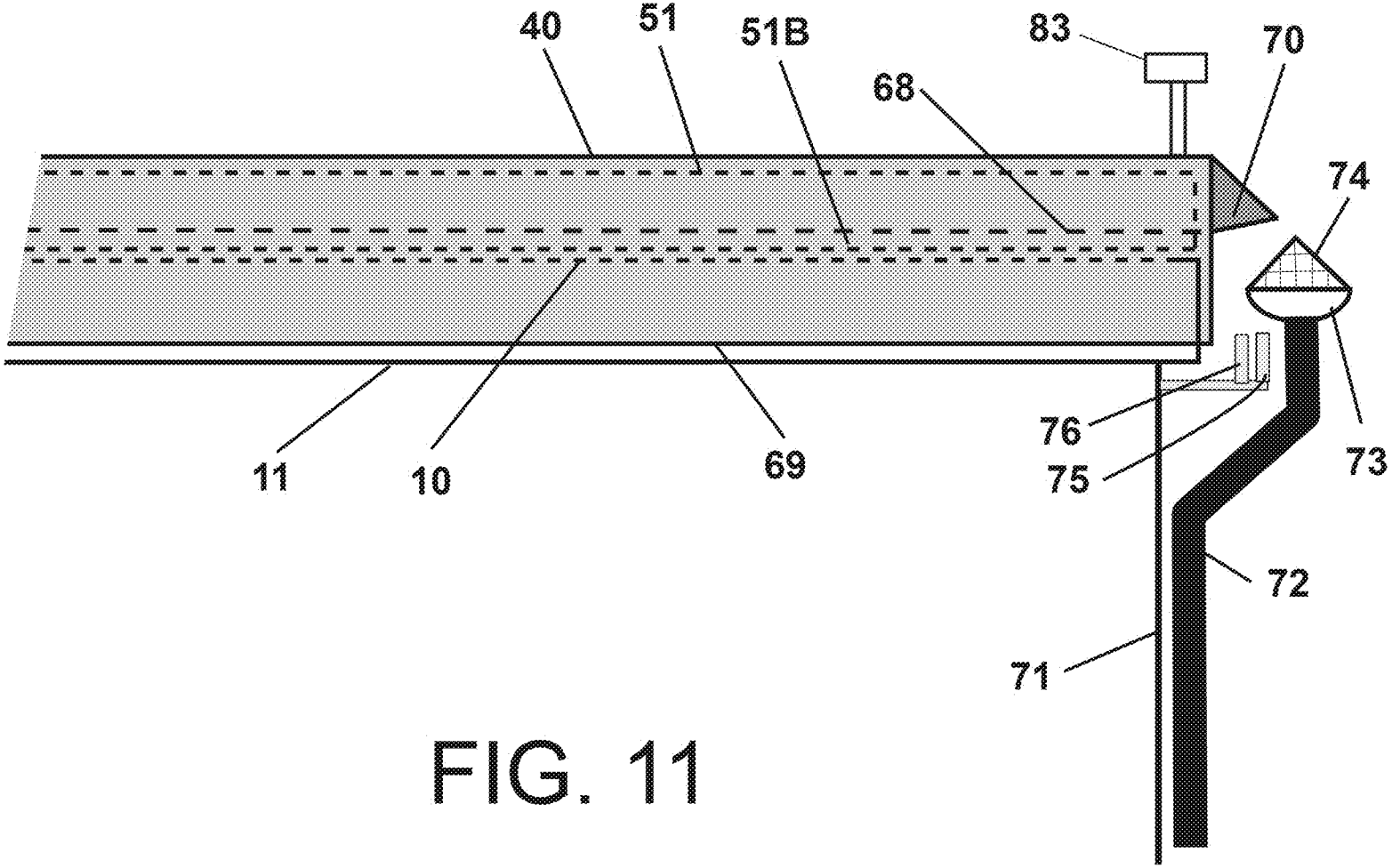
FIG. 11 is a front view of vertical gutter spout position next to gutter cover on a building's roof to receive water run-off from the roof. Other controls are also mounted on the side of the building and on top of the roof.

FIG. 11 is a front view of roof 10 equipped with gutter frame 51 and gutter cover 40. To provide all season efficiency of gutter cover 40, building 71 is equipped with drainpipe 72 for proper drainage. During the warm months of the year, rain will fall on roof 10 and flow into cover trough bottom 68 and flow out of cover trough end 70 into collection bowl 73. Screen top 74 is used above collection bowl 73 to keep leaves and other debris out of drainpipe 72. Drainpipe 72, collection bowl 73 and screen top 74 may be equipped with heating elements such as heat cable or other heating devices to melt snow and ice between gutter cover 40 and drainpipe 72, specially before one operates inflatable tubes 16*a* and 16*b* to lift up gutter cover 40. To control these heating elements, temperature switch 76 is wired to an automatic electronic controller 28 (FIG. 15) to automatically turn the heat on and off as required. The controller 28 can be a programmable logic controller, microprocessor, computer, or other type of electronic controller known to those having ordinary skill in the art. To operate the self-cleaning feature of gutter cover 40 in the warmer months/climates during the year, rain sensor switch 75 may activate blower 21 to inflate gutter cover 40 via inflate tubes 16*a* and 16*b* so that rain water may flow over sloped gutter cover 40, gutter frame 51 and remove leaves, dirt and other debris. A timer in the controller may be set to an inflation cycle to the desired time sequence. Also shown is wind gauge switch 83 on roof 10 to activate the vacuum procedure (operated by an additional vacuum blower) under gutter cover 40 to hold it tight against the roof in case of high wind conditions. Gutter cover 40 should be manually operated during the winter to remove ice dams and icicles to monitor the procedure because of the falling ice and snow hazard. Prior to any operation, alarm 38 should be activated before blower turns on.

Figure 12:
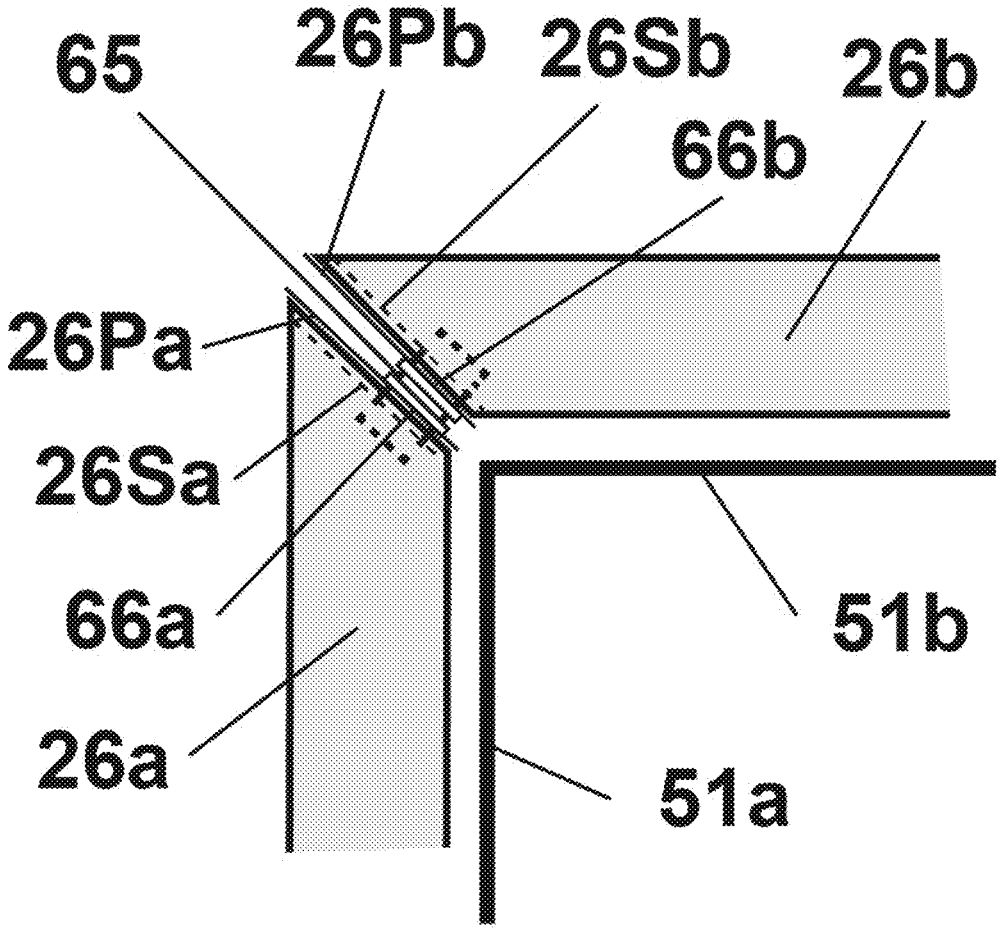
FIG. 12 is a top view of a corner section of a roof with inflate membranes connected via hose fittings.

FIG. 12 is a top view of roof sections 10*a* and 10*b* forming an exterior corner of roof 10 where inflate membranes 26*a* and 26*b* are connected together via connector air tube 65 with air connector ports 66*a* and 66*b*. Ends of inflate membranes 26*a* and 26*b* are closed via stitches 26Pa and 26Pb and end stitches 26Sa and 26Sb respectively.

Figure 13:
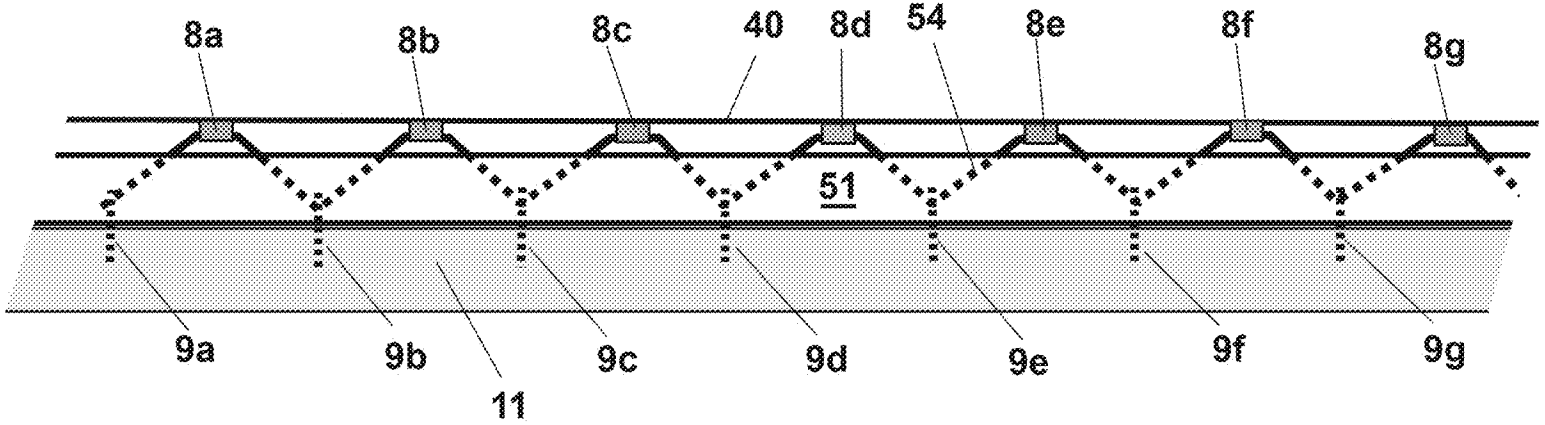
FIG. 13 is a front view of roof and eave of a building with a gutter frame and gutter cover installed. To help the gutter cover return properly inside the gutter trough after deflation, a length of bungee cord is attached between the underside of gutter cover and roof to apply a downward pull to gutter cover.

FIG. 13 is a cut-away, front view of gutter cover 40 equipped with cover loops 8*a* to 8*g* to hold and place downward tension on bungee cord 54 that is also held by eye screws 9*a* to 9*g* installed through holes in the base of gutter frame 51 and into roof 10. While it isn't always required, bungee cord 54 pulls gutter cover 40 back into position in gutter frame 51 after inflation.

Figure 14:
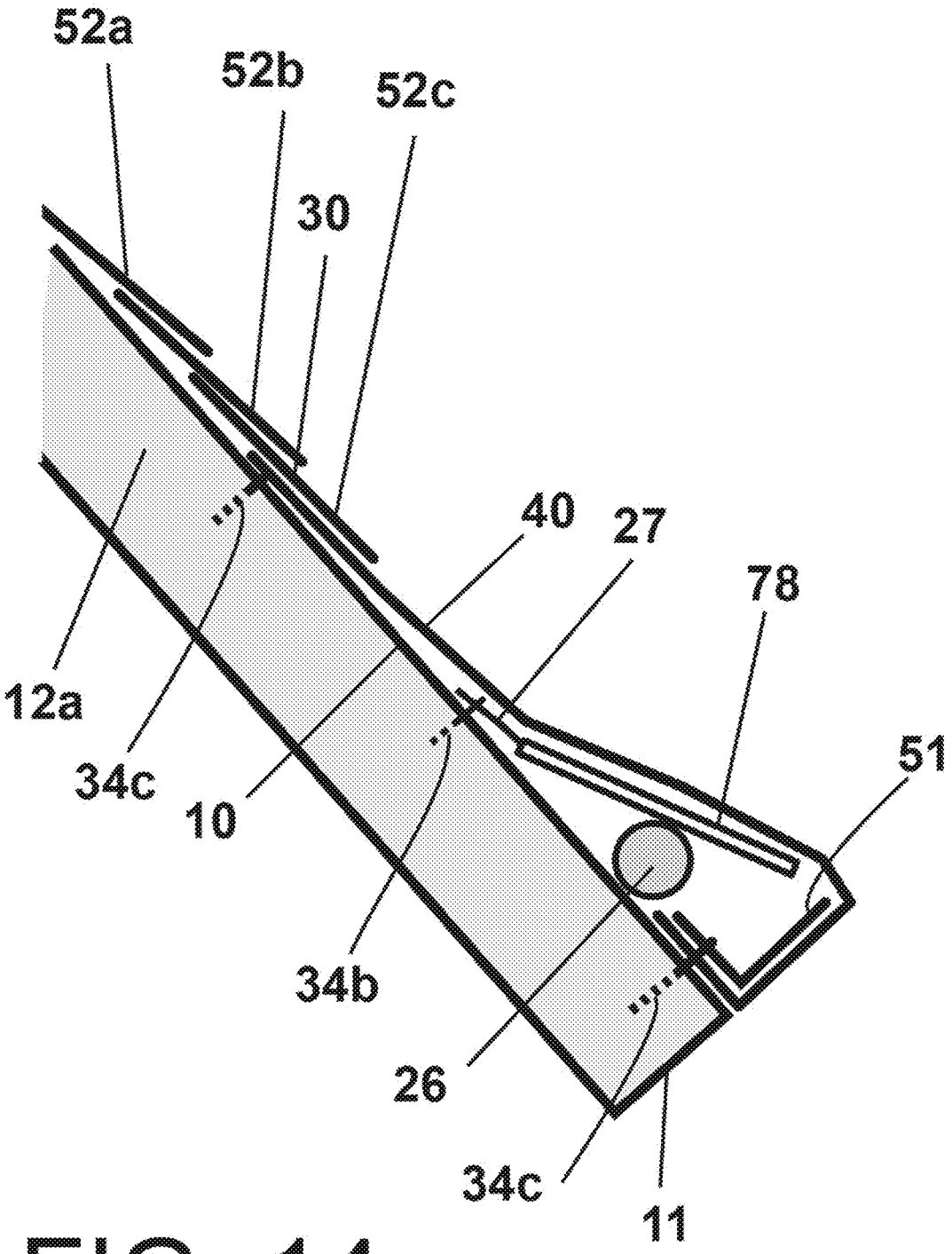
FIG. 14 is an end view of roof with gutter frame and gutter cover installed utilizing an inflate membrane placed between a hinge plate and gutter cover to provide a more precise lifting action of the gutter cover.

FIG. 14 is an end view of roof 10 equipped with gutter cover 40 that utilizes inflate membrane 26 positioned under lift plate 78 to provide a more precise lifting action. Lift plate 78 is equipped with inflate membrane flap 27, which acts as a hinge, attached to roof 10 via fastener 34*b*. Lift plate 78 can be made of semi-rigid material like stiff rubber sheet, plastic or fiberglass as well as a rigid material like metal or wood.

Figure 15:
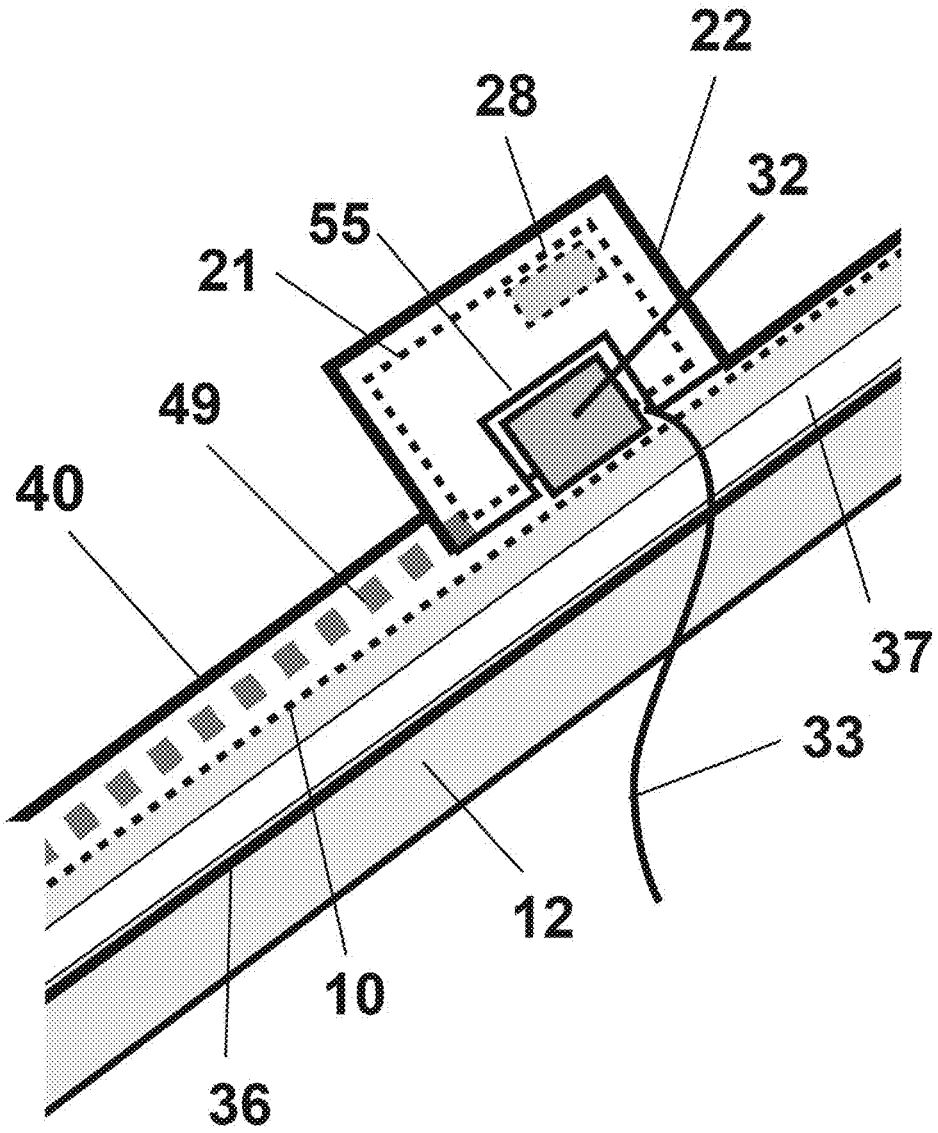
FIG. 15 is a side view of the blower components and control enclosure installed on roof under the gutter cover.

FIG. 15 is an end view of roof 10 with blower 21 and blower intake/exhaust 32 installed. As shown, blower enclosure cover 22 is installed on gutter cover 40 with waterproof seams to protect blower 21 and controller 28 from the weather and other hazardous conditions. Mounting blower 21 and other components such as controller 28 and blower outlet tube 49 under cover 40 not only eliminates the added costs and odd appearance of a rigid enclosure, clamps and air hose on a roof, but also provides easier hook-up and operation because the only external component is an electric cord 33. The edge of cover 40 extends over eave 11 and is fastened to eave 11 via clamp bar 37. Blower 21 can also be installed a build such as in an attic if desired.

Figure 16:
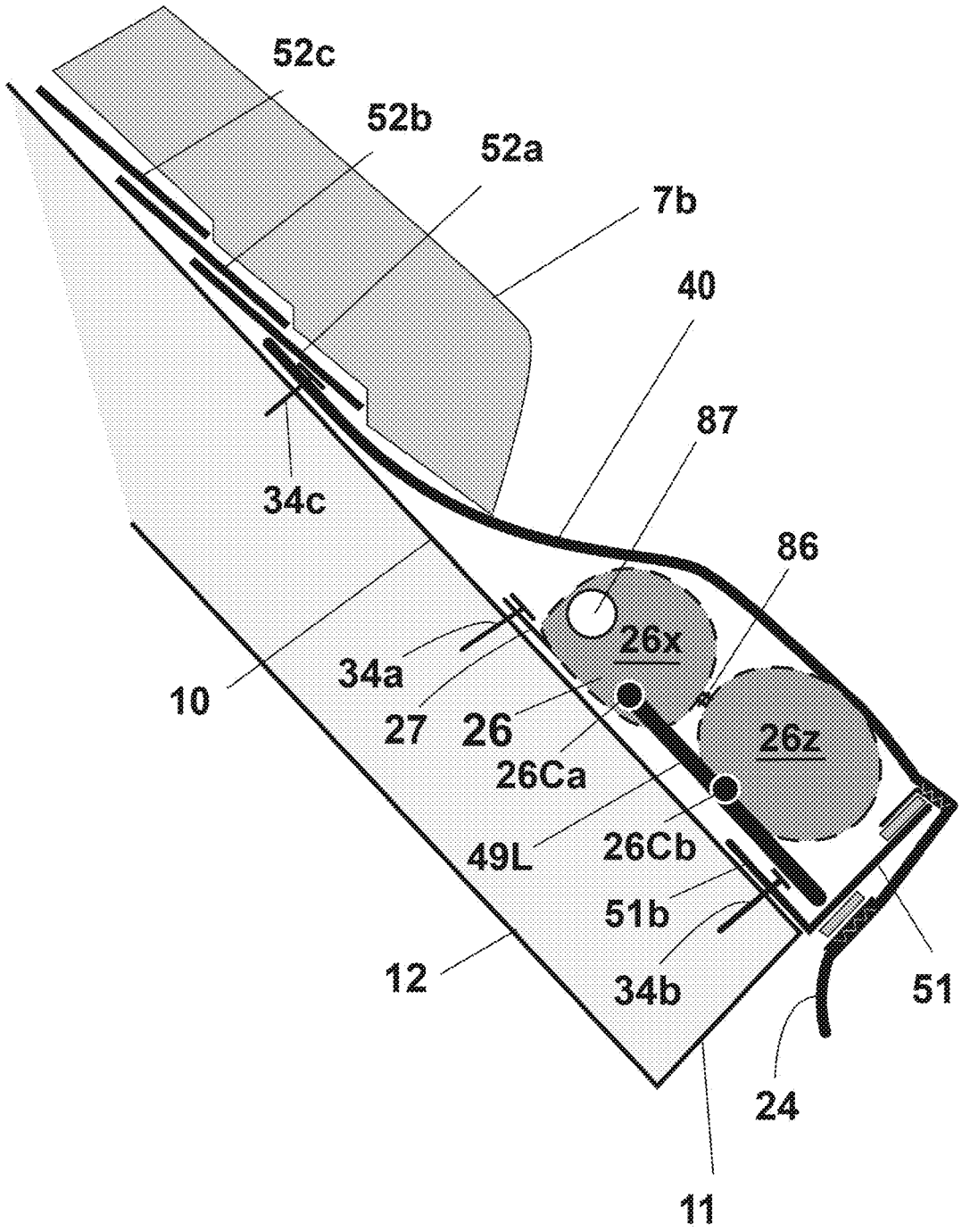
FIG. 16 is an end view of roof with a two compartment inflate membrane under gutter cover which can provide greater support under gutter cover especially for large roofs.

FIG. 16 is an end view of roof 10 with gutter frame 51 and gutter cover 40 installed which uses a single inflate membrane 26 that is divided into two compartments, 26*x* and 26*z* via stitch 86 to provide greater support under gutter cover 40. Notice that both inflate compartments 26*x* and 26*z* are equipped with an inflate tube coupler 26Ca and 26Cb from blower outlet tube 49L. This configuration may be used on a large commercial building having a large roof surface area requiring a larger than normal gutter assembly which could collect large amounts of ice. Also shown is pressure relief opening 87 that allows low pressure air to exit inflate membrane 26*x* when the air pressure builds too high, exceeding a predetermined threshold. For example, once the pressure inside inflate membrane 26 reaches a pressure that is high enough to remove a heavy ice and snowpack from roof 10 which might be 20" $H_2O$, air is exhausted to prevent over pressurization of inflate membrane 26 which could cause damage to it. A high-pressure electrical switch (such as a Dwyer #1910-20) can also be added to blower 21 which will turn off blower 21 when a certain high-pressure setting (20" $H_2O$) is reached.

Figure 17:
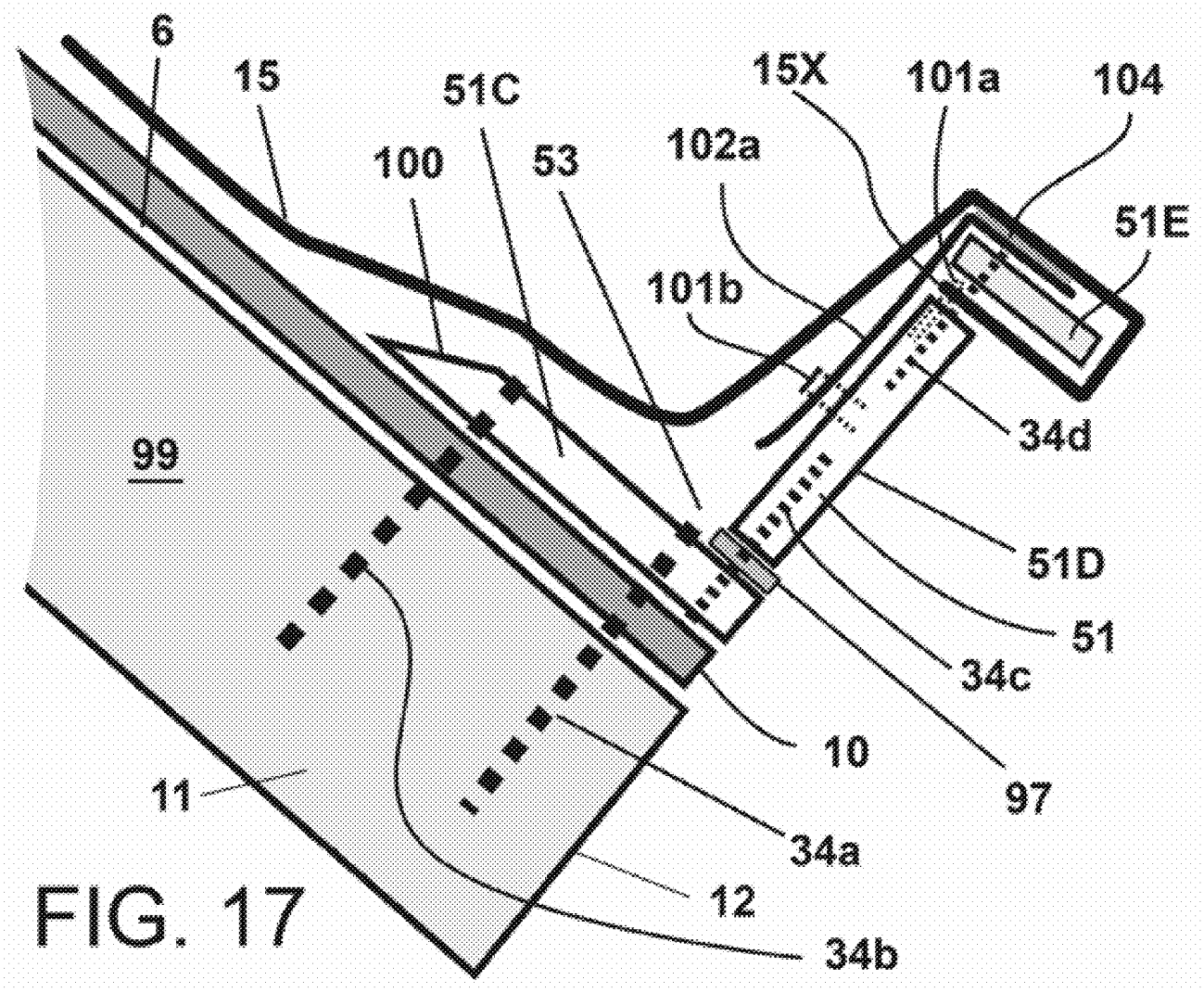
FIG. 17 is a cut-away view of a roof having a gutter frame comprising a mounting plate and a face forming a gutter trough.

FIG. 17 is a side view of the bottom of a roof showing rafter 99 and roof deck 10 with gutter frame 51 attached to roof deck 10 via fasteners 34*a* and 34*b*. Gutter frame 51 is composed of gutter frame mounting plate 51C which is secured to gutter frame face 51D via applying wood glue such Titebond Ultimate III™ wood glue 97 and fastener 34*c* glue. Gutter frame mounting plate 51*c* and gutter frame face 51D may be made of a rigid material, such as ½" thick birch plywood cut from 4×8 foot plywood sheets, into 4" to 8" wide panels (depending on the capacity of the gutter) for a particular roof. To join the gutter frame mounting plate 51C to the gutter frame face 51D, a bead of wood glue 97 between the two and clamped in place. Prior to inserting a fastener, such as a sharp pointed construction screw with coarse threads, a small pilot hole should be drilled into both wood panels to reduce the chance of the plywood splitting. As shown, construction screw 34*c* is placed in gutter frame mounting plate and then up through gutter face panel 51D. After wood glue 97 dries, a very strong bond is created. As shown, once the gutter frame assembly has been completed and the glue allowed to cure with fastener 34*c* holding strong, gutter frame 51 is remarkably strong and very low in cost. The average cost of this type of gutter frame is less than $1/linear ft. To ensure gutter frame 51 is secured properly, similar fasteners 34*a* and 34*b* are fixed to each rafter 99 along the roof deck. Also notice the top end of gutter frame mounting plate 51C is beveled 100 to allow water to run easily into gutter trough 53. As shown, bottom end 15X of cover 15 is attached to the top surface of gutter frame face 51D beginning with staple 101*a*. This process allows the installer to hang cover 15 from gutter frame 51 for easy installation. Once cover 15 is secured along the roof deck for as long as the installer wants (up until a corner), the next step is for the installer to place gutter frame top drip edge plate 51E on top of gutter frame face 51D and end section 15X of cover 15, installer adds fastener 34*d* to hold these components sandwiched together. Gutter frame top drip edge plate may also be made of a strip of ½" plywood. The primary reason why wood is used as the gutter frame 51 is because cover 15 and cover tab 102*a* can be attached very quickly and easily with a staple gun. As shown, during the time when the cover 15 is slit from a roll of 71.5" wide fabric into (2) 35½" panels, cover tab 102*a* is attached to underside of cover 15 via heat-sealing 104 or via gluing or sewing. Heat-sealing is generally the best method because heat-sealing is very fast, strong and efficient. After gutter frame top drip edge plate is installed, the installer pulls down tightly on cover tab 102*a* and staples it to gutter face via staple 101*b* which holds cover 15 in the proper location and proper alignment with gutter trough 53. One of the more useful benefits and characteristics of the gutter frame top drip edge plate is that any water, ice, or snow is kept away from the fascia board 12, soffit 98 (not shown in this figure) and eave 11 of the roof 6. During the testing of one of the residential roof prototypes, several workers (400 pounds) actually hung from an 8' length of the gutter frame 51 with ease and in complete safety. While FIG. 17 shows the installation of gutter frame 51 directly attached to roof deck 10, it can also be installed directly over existing and new shingles 52 (not shown in this figure) if desired.

Figure 18:
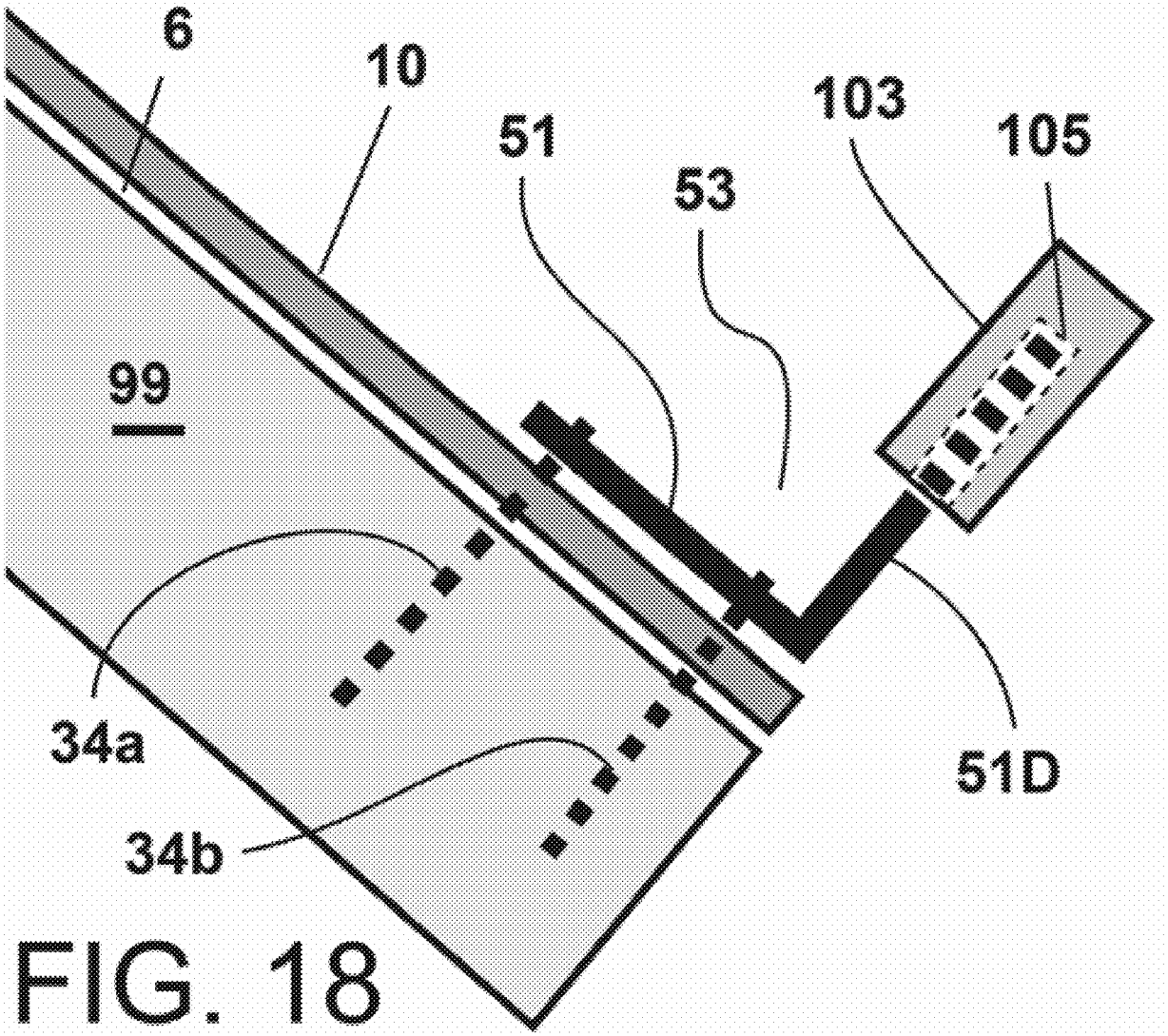
FIG. 18 is a cut-away view of roof having a gutter frame made of a structural angle.

FIG. 18 is a side view of gutter frame 51 which can be made of a rigid material such structural angle or L-shape made of steel, Fiberglas® glass-reinforced plastic (GRP) material or aluminum with wood cap 103 on a top edge. For a commercial roof 6 that may have a long and steep slope such as a church, gutter frame 51 may have to collect copious amounts of rainwater as well as hold back a heavy snow pack from sliding off the roof 6, weighing as much as several hundred pounds per linear foot, which may also include hundreds of pounds of icicles, ice dams and other debris. As shown, gutter frame 51 may be made of ¼"×10"×10" aluminum angle with wood cap 103 made from a 1"×4" length of wood that has been run through a router to create slot 105 to fit tightly over the gutter face 51D and then glued in place. Wood cap 103 is used in the same manner than gutter frame 51 shown in FIG. 17 to enable the installation crew to use a pneumatic nailer or stapler to install cover 15. Using wood components as part of gutter frame 51 may be used because once cover 15 is attached, gutter frame 51 remains in a weatherproof and dry environment.

Figure 19:
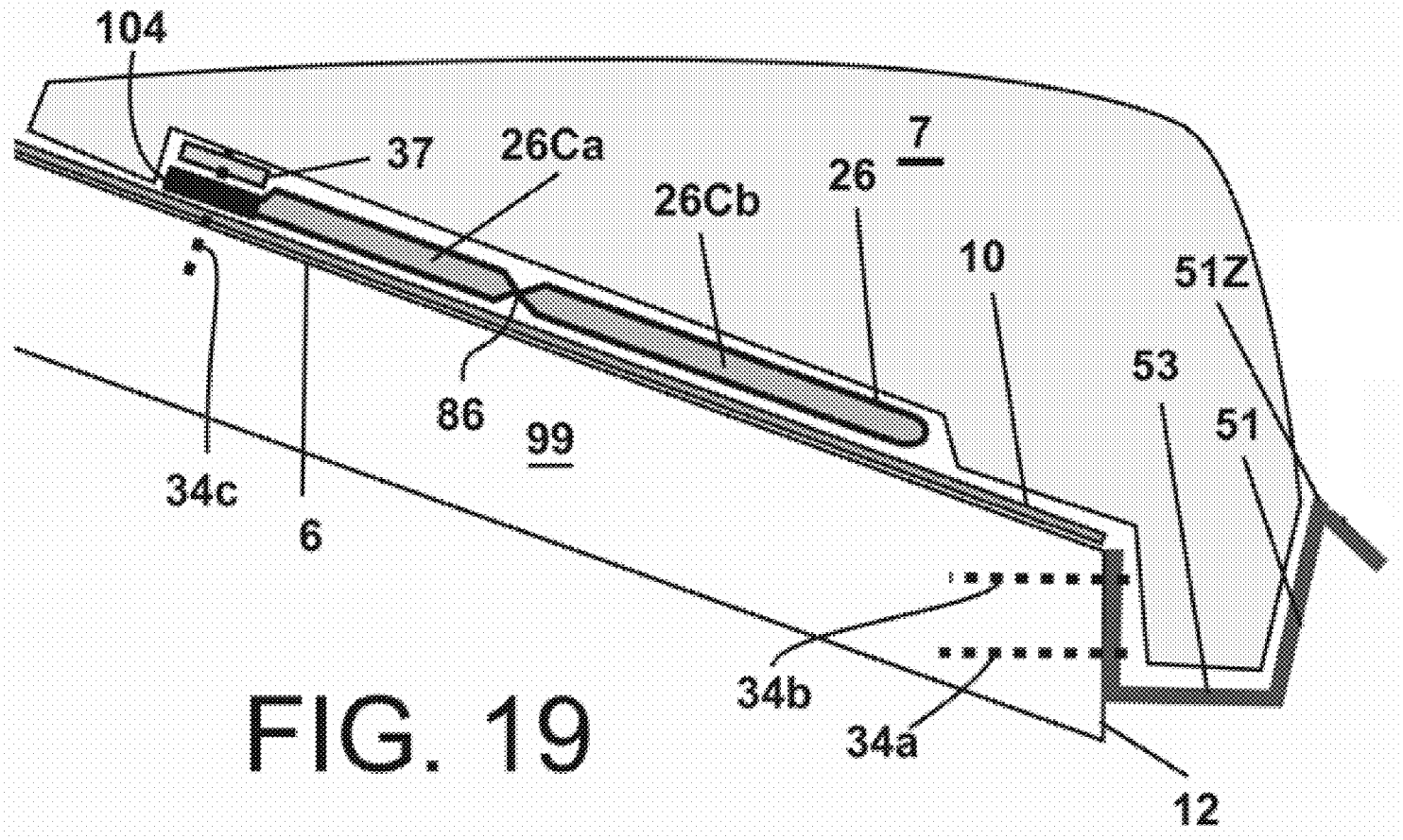
FIG. 19 is a cut-away view of roof and a U-shaped gutter frame.

FIG. 19 is a side view of roof 6 that has a shallow slope angle of approximately 12° that will not accommodate a standard gutter frame 51 that has a gutter face of about 4 to 6". In addition to this issue, when inflate membrane 26 is fully inflated it will act as a brake, not allowing snow 7 higher on roof 6 to slide off roof 6. As a result, a substantially U-shaped gutter frame 51 has been secured to fascia board 12 of eave 11. As shown, top of gutter frame 51 shows gutter frame top drip edge plate 51Z higher than end of roof deck 10 higher to provide the brake action. Also, as snow 7 compacts in gutter trough 53 and becomes more of a solid mass as opposed to light and fluffy snowflakes, additional holding and brake action is provided by gutter frame 51.

Figure 20:
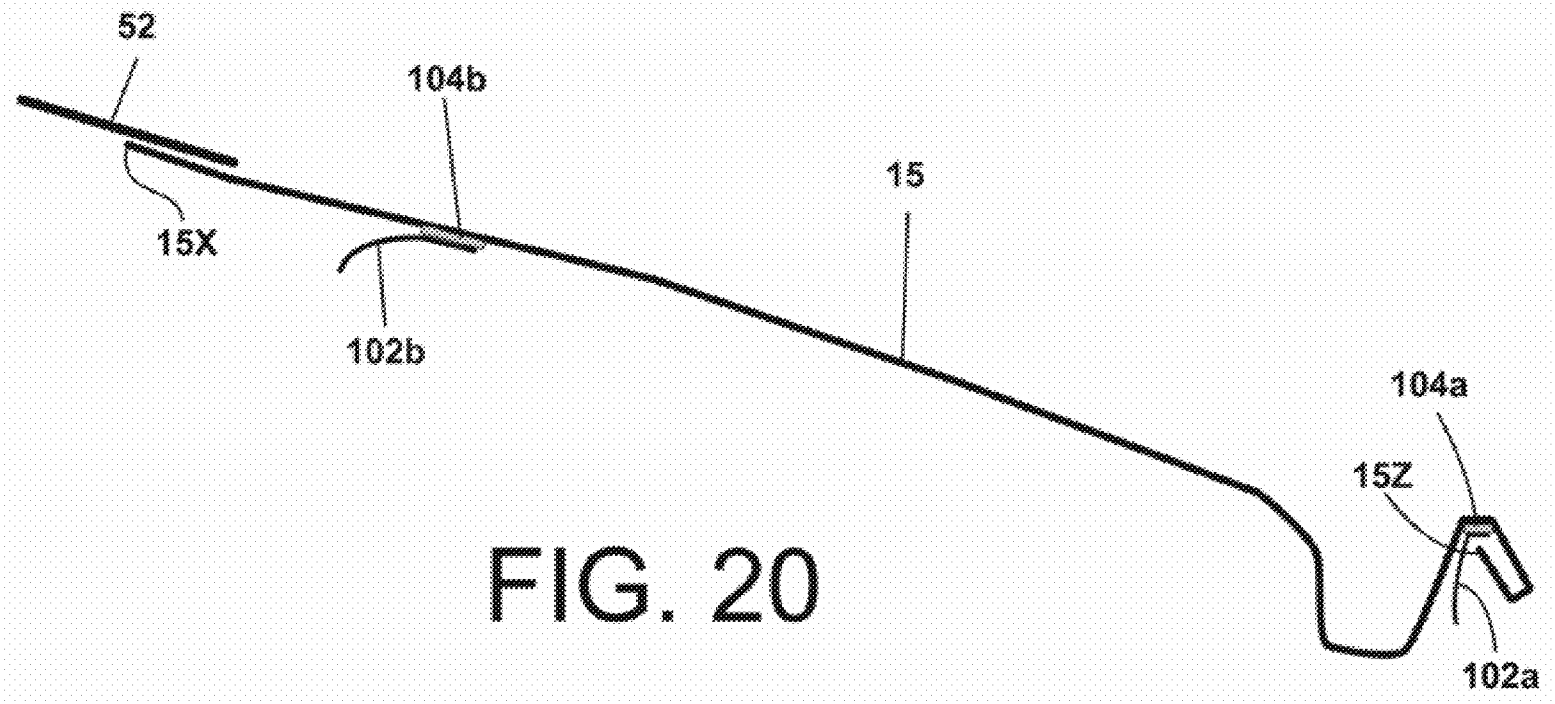
FIG. 20 is a side elevation of a flexible cover and two cover tabs.

FIG. 20 is a side view of cover 15 with at least one cover tab 102*a* and 102*b* secured to the underside of cover 15 via heat-seals 104*a* and 104*b* respectively. Also shown is top end of cover 15X tucked under shingle 52. Other types of roof systems instead of shingles 52 could also be used, such as roofs made of metal panels, Fiberglas® or plastic panels, metal shingles, wood split-shake, tile, ceramic, etc. Because the top surface of cover 15 may be exposed to the sun and UV radiation for years and decades, special consideration needs to be evaluated and applied. To protect PVC coated fabrics from UV radiation, manufacturers add chemical stabilizers like UV absorbers (e.g., benzotriazoles, benzophenones) to convert UV light to heat, and hindered amine light stabilizers (HALS) to neutralize damaging free radicals, often combined with pigments like titanium dioxide (TiO2) and/or carbon black for scattering UV light and antioxidants to prevent degradation, ensuring durability and preventing yellow/cracking. Also, special films may be laminated to the top surface of cover 15 such as Tedlar® polyvinyl fluoride (PVF) film, and Kynar® polyvinylidene fluoride resin (PVDF) film to extend the life of cover 15 but also provide a protective layer to shed dirt and crime keeping the cover 15 in pristine condition. There are many PVC-coated polyester fabrics like Seaman Corp's XR-3® and XR-5® polyester geomembrane fabric that have a weight in the range of between 22 to 32 ounces and have a lifetime guarantee of about 10 years. Other long lasting woven PVC-coated polyester-based fabrics such as Seaman Corp's Fibertite® polyester roofing fabrics coated with ketone ethylene ester (KEE) have a lifetime guarantee of up to 30 years. Most roofing fabrics, regardless of the manufacturer, are made with a white PVC coating which helps reflects the sun's rays to further extend the life of the fabric as well as to keep a buildings'indoor temperature cooler. Still, other types of long-lasting coated fabrics can include the use of silicone, Teflon®, and PTFE coatings and infused with Fiberglas® to provide even longer lasting fabrics—up to 60 years. Based on the types of fabrics available, the standard cover 15 will be made of either XR-3® or XR-5® fabric, both having a life of about 10 years. It is also important to note that a cover 15 of this type can be flipped over and reused with the bottom surface now us as the top surface. It is a fairly simple and easy process, even on-site, to remove the old cover tabs 102*a* and 102*b* from the old cover surface and install new cover tabs on the reversed side which is basically in new condition. Also, these PVC-coated fabrics can be maintained with Armor All® XL8 rubber coating, Cerakote® and 303® aerospace protectant, etc. to extend the life and/or appearance of PVC-coated fabrics. While there are woven fabrics coated with rubber compounds, such as natural rubber, neoprene, SBR, Hypalon™ synthetic rubber, nitrile, butyl, EPDM (ethylene propylene diene monomer), silicone, Viton® synthetic rubber, etc., that may be suitable for use as cover 15, PVC-Coated fabrics may be more economical and better suited for high-speed, production type heat-sealing.

Figure 21:
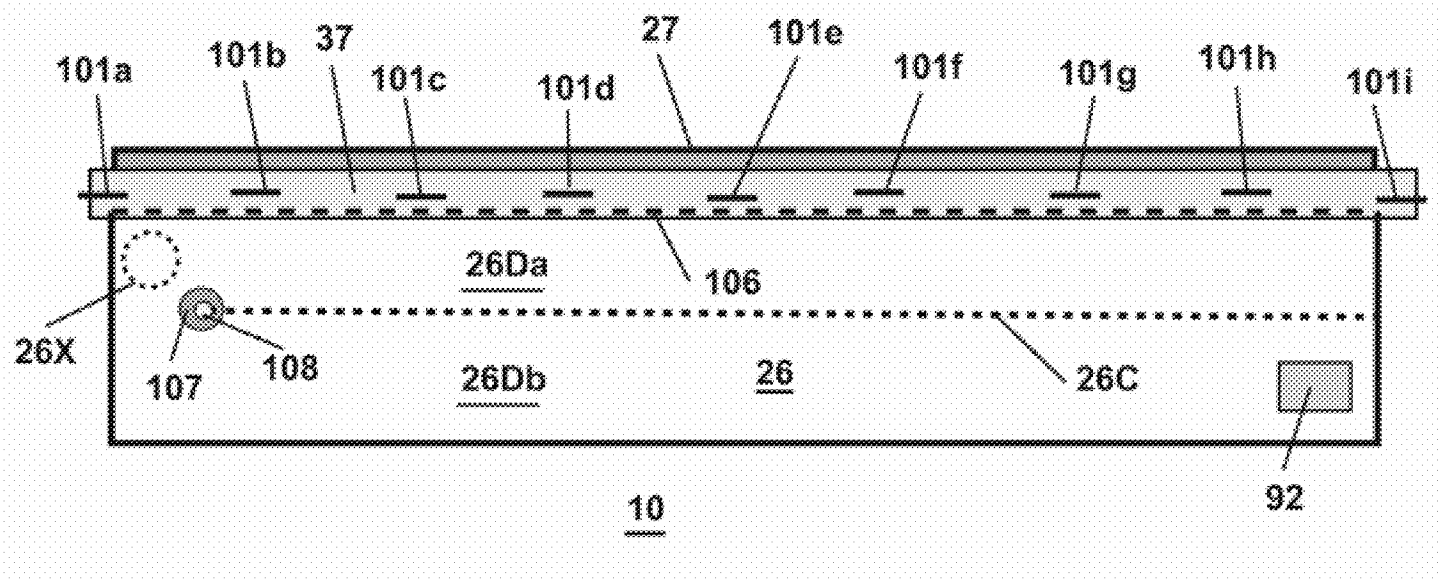
FIG. 21 is a plan view showing installation details of a two part inflate membrane installed on a roof.

FIG. 21 is a top view of inflate membrane tab 27 of inflate membrane 26 fastened to roof deck 10 via clamp bar 37 and fasteners such as staples 101*a*, 101*b*, 101*c*, 101*d*, 101*e*, 101*f*, 101*g*, 101*h* and 101*i*. In this application, a clamp bar made of a strip of ¼"×1" plywood is used so that a pneumatic stapler and/or nailer can be used. Clamp bar 37 could also be made of steel, aluminum, plastic, etc. or as required. Notice that clamp bar 37 may be positioned with its lower edge immediately next to, on, or slightly over sealed edge 106 to reduce any pressure directly on the heat-seal or stitch. Clamp bar 37 also enables inflate membrane 26 to be positioned, inflated, and deflated on a straight line with even downward pressure along its length. Also shown is inflate membrane coupler 26X for attached the air supply to inflate membrane 26 as well as compartment seam stitch 26C to divide inflate membrane with inflate membrane compartments 26Da and 26Db. If for example, an application calls for a gap to be left between inflate membrane compartments 26Da and 26Db, one or more compartment seam stitches 26Cb can be made parallel to compartment seam stitch 26C, leaving a non-inflatable area between inflate membrane compartments 26Da and 26Db of inflate membrane 26. Left end of compartment seam stitch 26C is covered and squeezed together with washer 107 and stitch end fastener 108 to keep area around the end of compartment seam stitch 26C from inflating and possibly rupturing. To limit the amount of pressure inflate membrane 26 can withstand and not be damaged with blower pressure as high as 3.5 PSI (maximum air pressure), breathable pressure relief vent 92 is installed on inflate membrane 26 to limit the maximum pressure to a range between 0-1.5 PSI, which inflate membrane 26 can easily withstand.

Figure 22A:
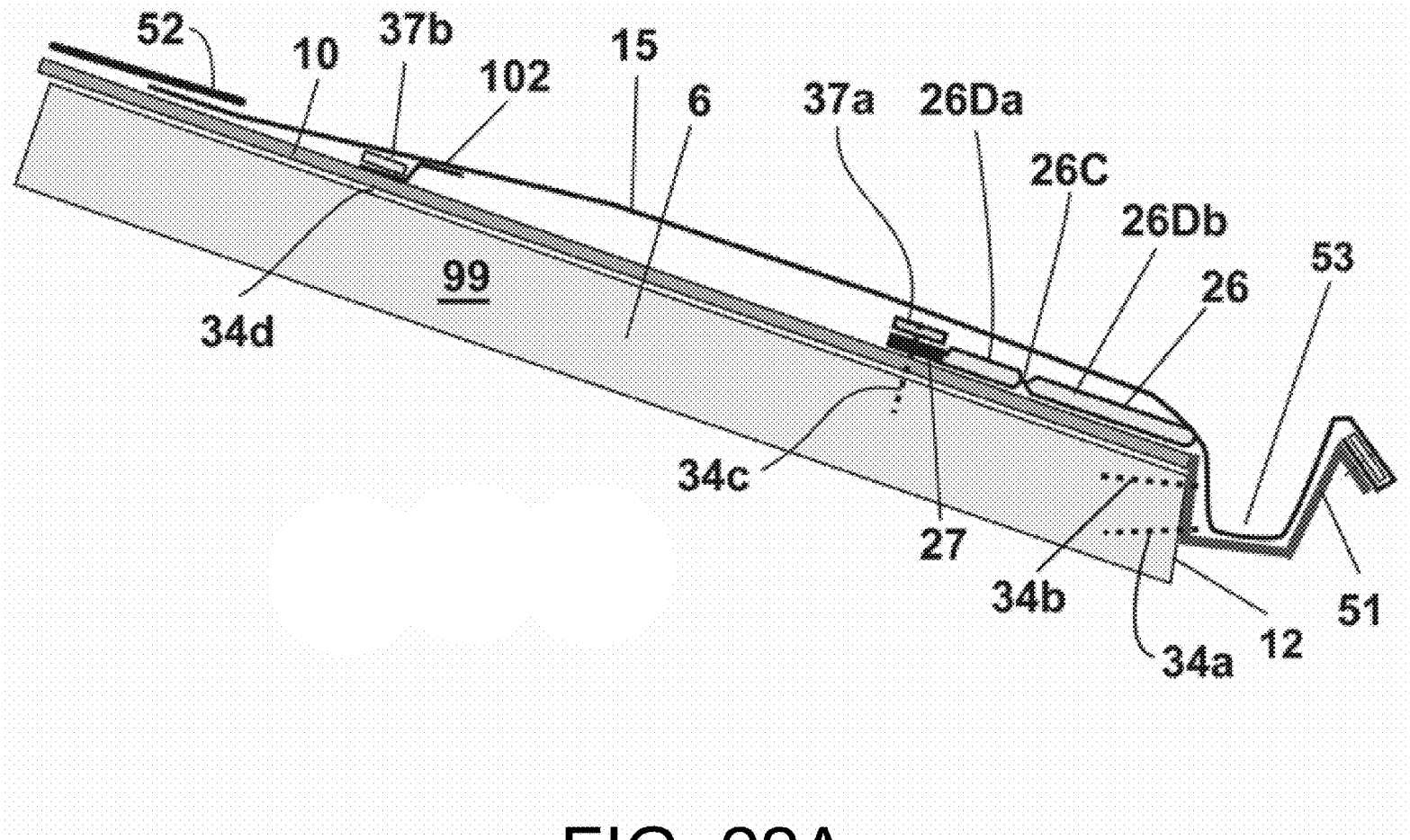
FIG. 22A is a cut-away view of a roof with a two-part inflate membrane in a deflated state.
Figure 22B:
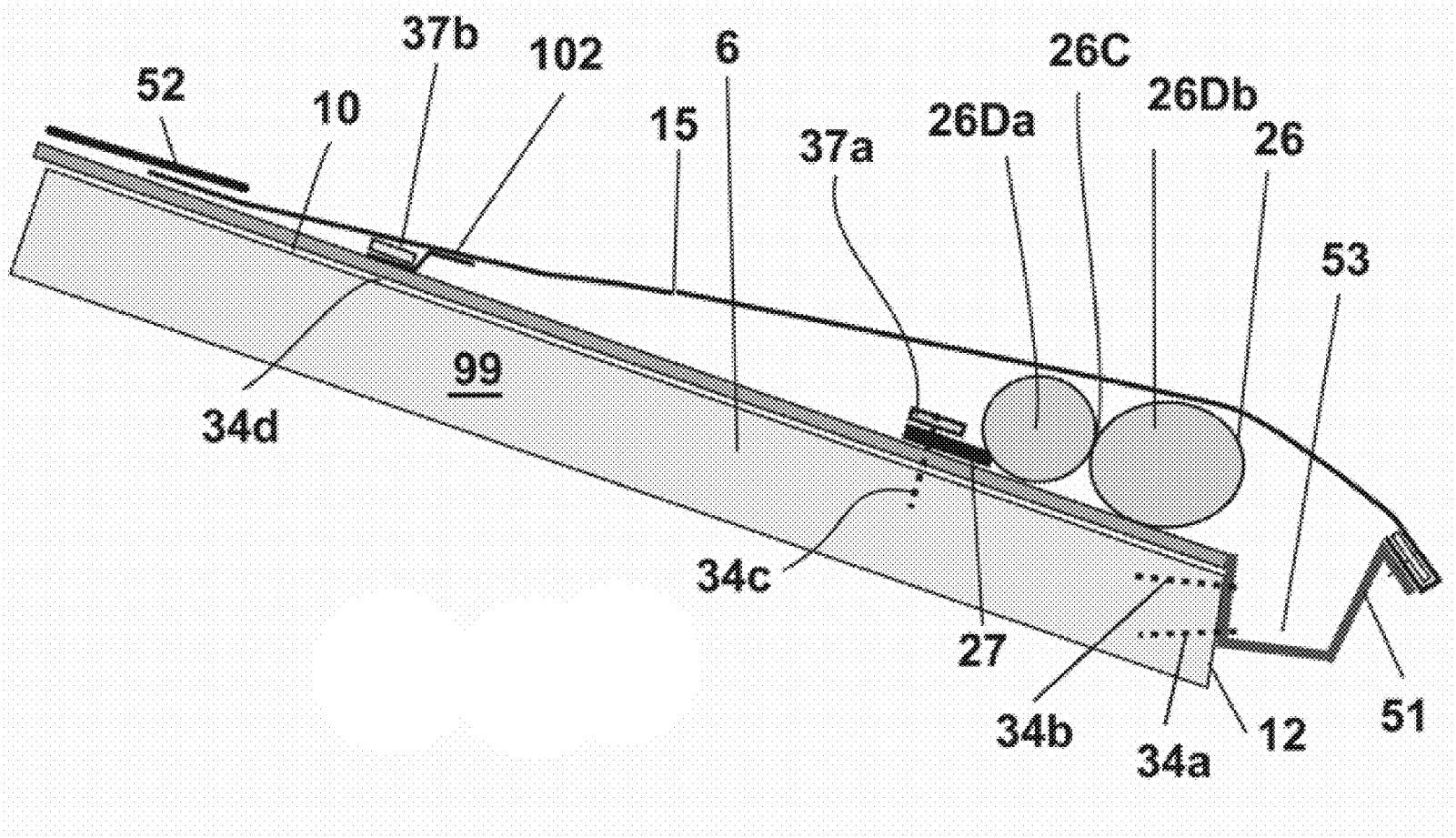
FIG. 22B is a cut-away view of the view of FIG. 22A with the two-part inflate membrane in an inflated state.

FIGS. 22A and 22B are side views of flexible cover 15 and inflate membrane 26 installed on roof deck 10 of roof 6. Notice in this configuration that gutter frame 51 is mounted directly to fascia board 12 near eave 11. In FIG. 22A, inflate membrane 26 is shown in a deflated condition fixed to roof deck 10 via clamp bar 37*a* and fastener 34*c*. Upper section of cover 15 is held in place on roof deck 10 via cover tab 102, clamp bar 37*b* and fastener 34*d* while the bottom of cover 15 end is held in place and attached to gutter frame 51. In FIG. 22B, inflate membrane compartments 26Da and 26Db are inflated, raising cover 15 up and out of gutter trough 53 for the removal of leaves, ice, and snow from roof 6.

Figure 23:
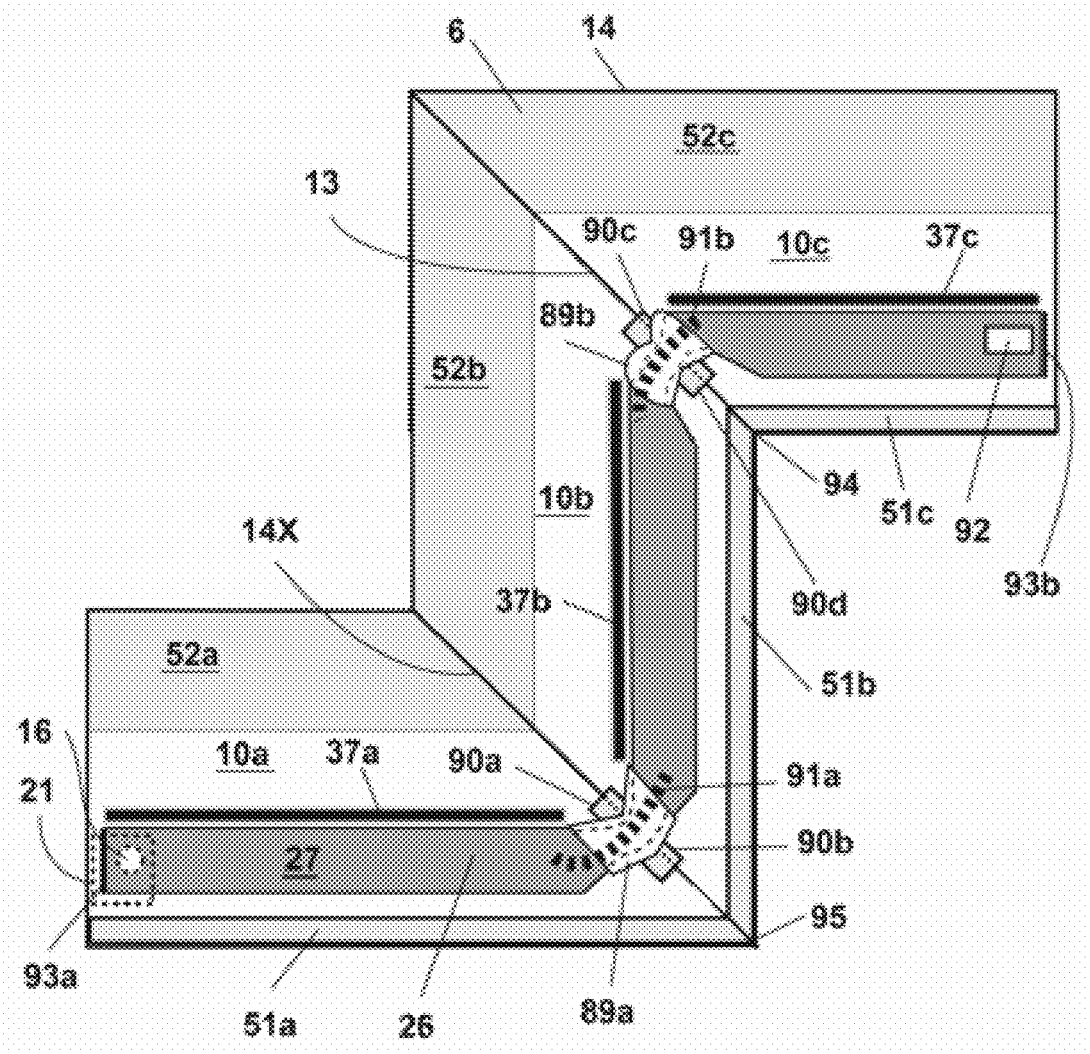
FIGS. 23-25 are plan views of a self-cleaning roof and gutter system adapted for roof sections that are angled with respect to each other.
Figure 24:
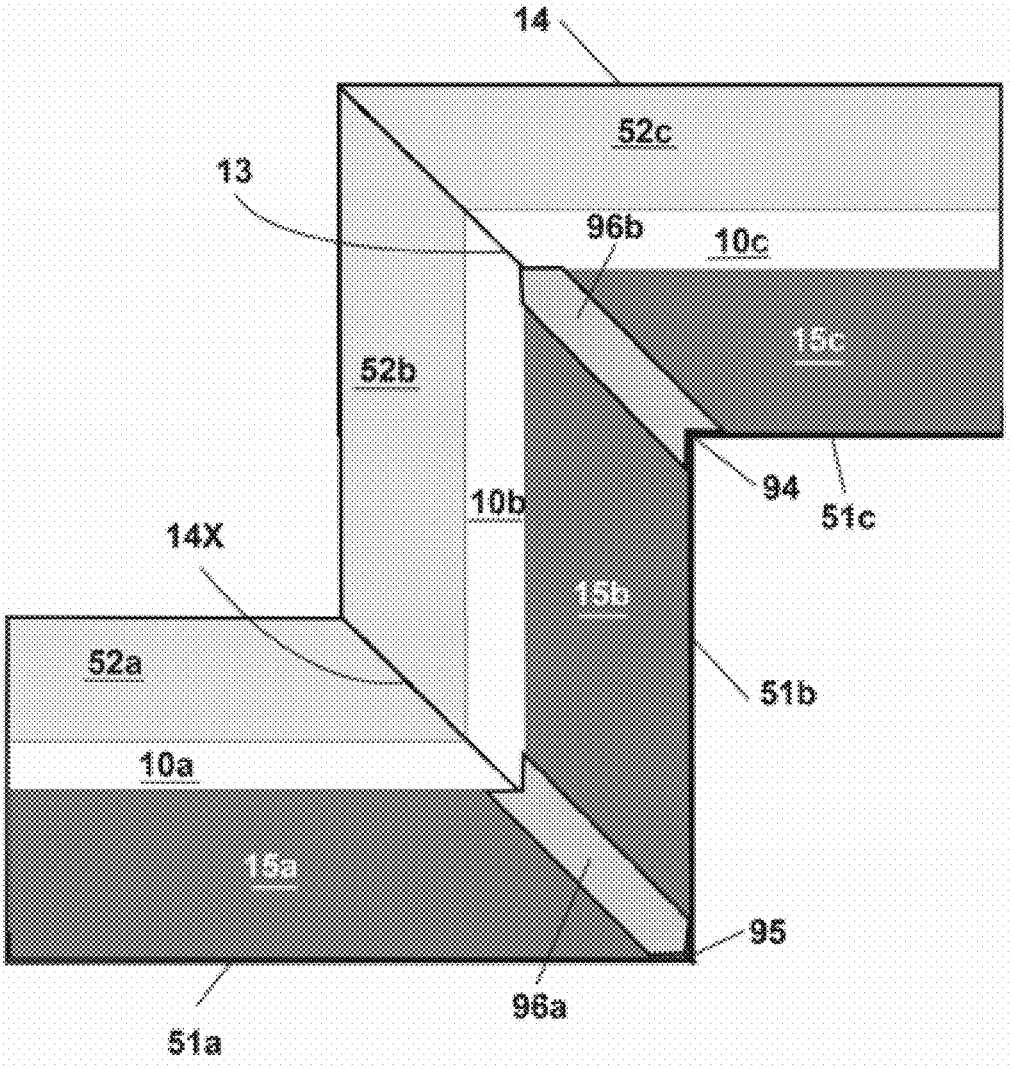
Figure 25:
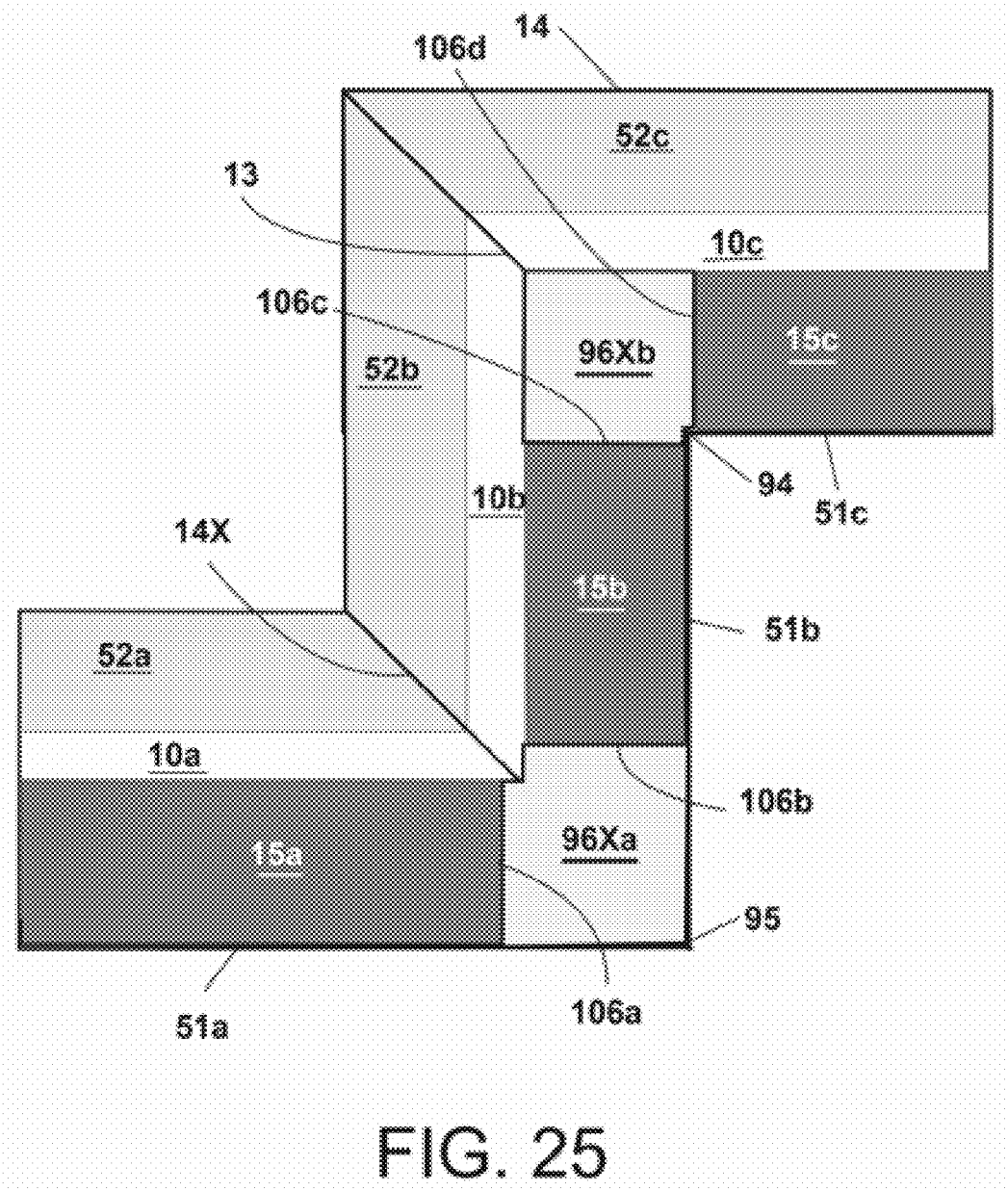

FIGS. 23, 24 and 25 are top views of a roof 6 that is divided into three styles of roof sections by roof edge inward corner 95 and roof edge outward corner 94. Coinciding with roof edge inward corner 95 of roof 6 is roof ridge 14X while roof edge outward edge 94 forms roof valley 13. Going from straight sections of roof 6 with a plurality of corresponding gutter frames 51*a*, 51*b* and 51*c* installed, inflate membrane 26 is a continuous length from beginning to end needs to be reconfigured and managed as it passes over roof ridge 14X and roof valley 13. As shown, to make inflate membrane 26 turn at a 90° angle on roof deck 10*a*, 10*b* and 10*c*, restriction collars 89*a* and 89*b* are placed over and around corresponding inflate membrane sections 26*a*, 26*b*, and 26*c*, while transfer tubing 91*a* and 91*b* are placed inside inflate membrane in these areas for pneumatically connecting them. To hold inflate membrane 26 and transfer tubing 91*a* and 91*b* secured in place, restriction collars 89*a* and 89*b* are equipped with restriction collar tabs 90*a* and 90*b* and 90*c* and 90*d* respectively. Restriction collar tabs 90*a*, 90*b*, 90*c* and 90*d* may then be fastened to roof deck 10 via screws, roof nails and/or staples. Notice that clamp bars 37*a*, 37*b* and 37*c* hold down inflate membrane 26 in parallel alignment with gutter frames 51*a*, 51*b* and 51*c*. Also, to install cover 15 and inflate membrane 26, shingles 52 in these areas may be removed while the shingle sections 52*a*, 52*b* and 52*c* remain. An inflate membrane end closure 93 may be used an inflate membrane section. In FIG. 24, cover 15 is cut into three sections 15*a*, 15*b* and 15*c*. Cover sections 15*a* and 15*b* are joined together with cover connector panel 96*a* while cover 15*b* and 15*c* are connected via cover connector panel 96*b*. Covers 15*a*, 15*b* and 15*c* may be attached to cover connector panels 96*a* and 96*b* via vinyl cement and/or heat-sealing. In FIG. 25, prefabricated substantially square corner panels 96Xa and 96Xb can be joined with covers 15*a*, 15*b* and 15*c* which can be made in custom sizes to conform with roof slopes that have a slope range from 1° to 90°. In some cases, using prefabricated corner panels allow the installer to make straight cuts and straight seals/joints. Prefabricated corner panels can also be equipped with bungee cords to help pull these panels back into place after inflation as deflation takes place. It is important that when covers 15 and corner panels 96X do not fold or create blockage in gutter trough 53 so the flow of rainwater is not blocked or otherwise interrupted.

Figure 26:
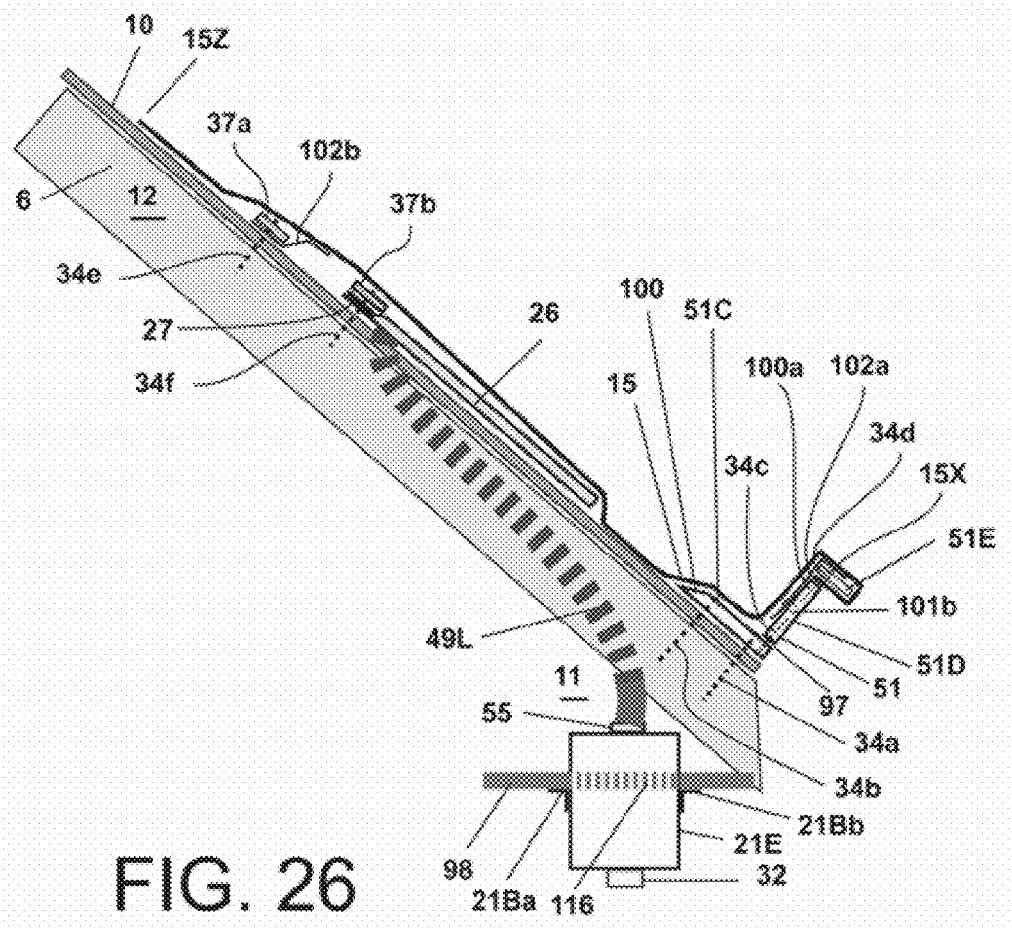
FIG. 26 is a cut-away view of a completed self-cleaning roof and gutter system with a blower and blower line.

FIG. 26 is a side view of a completed installation gutter frame components 51, inflate membrane components 26, cover components 15 and blower 21 with associated components on roof 6. To provide easy access to and a simple and straightforward installation process, blower enclosure 21E with blower 21 disposed inside, enclosure opening 116 is cut into soffit 98 on eave area 11 to allow blower line 49L to run inside and between a set of roof rafters 99 and directly under roof deck 10 and most importantly so it isn't seen from the outside. In this configuration, a viewer can only see the bottom half of blower enclosure 21E, blower enclosure brackets 21Ba and 21Bb, and blower intake/exhaust 32 as well as gutter frame 51, fascia board 12 and cover 15.

Figure 27:
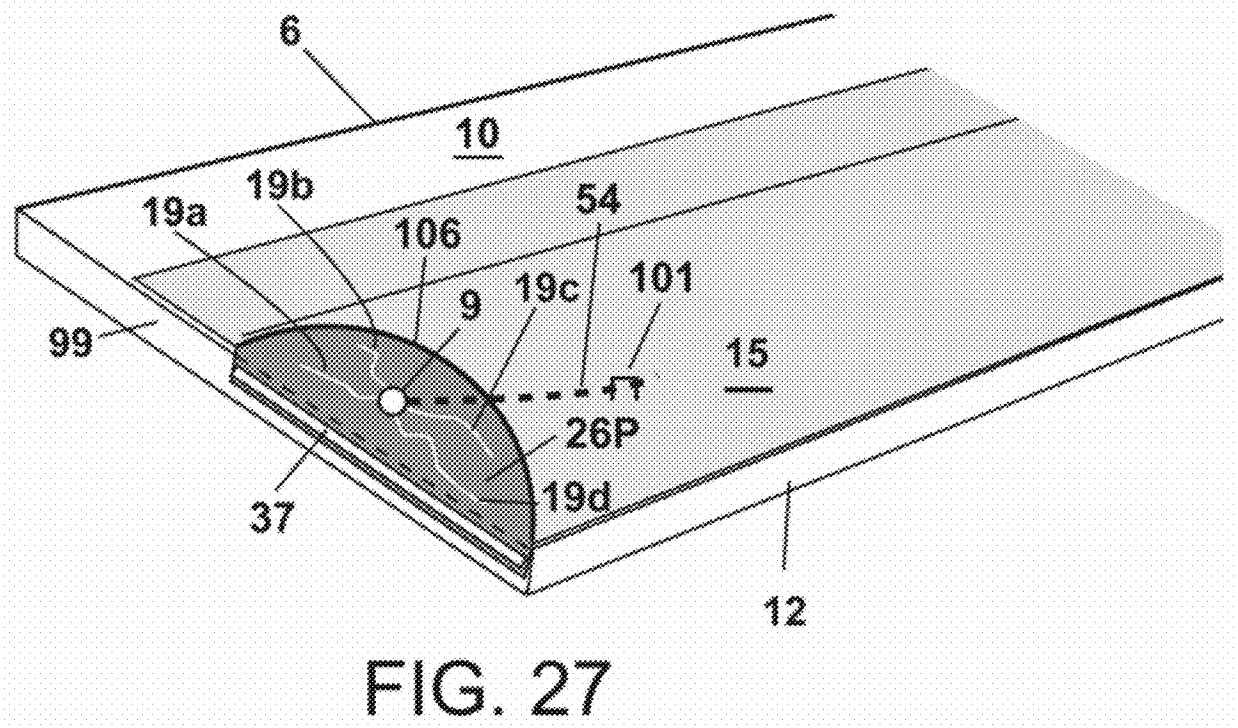
FIG. 27 is an orthogonal view of details of an end portion of a cover having an end panel.

FIG. 27 is a perspective view of cover 15 that is in an inflated position installed on roof 6. To keep rain, water, snow, dust and other elements from the area between roof deck 10 and under cover 15, an end panel 26P is attached to a lateral end of the cover 15 via sealed edge 106 which made be made via heat-sealing, vinyl cement and/or stitching. To keep end panel 26P from bellowing, collapsing and folding beyond outside edge of cover 15, bungee cord 54 is attached to a fastener such as an eye screw 9 which is fixed to end panel 26P and anchored to roof deck 10 via another fastener such as a staple 101. Bungee cord 54 will allow cover 15 to expand outward during inflation, but once inflation stops and deflation begins, end panel 26P will be pulled back and inside cover 15. The figure shows the end panel 26D having folds 19*a-d* when deflated.

Figure 28:
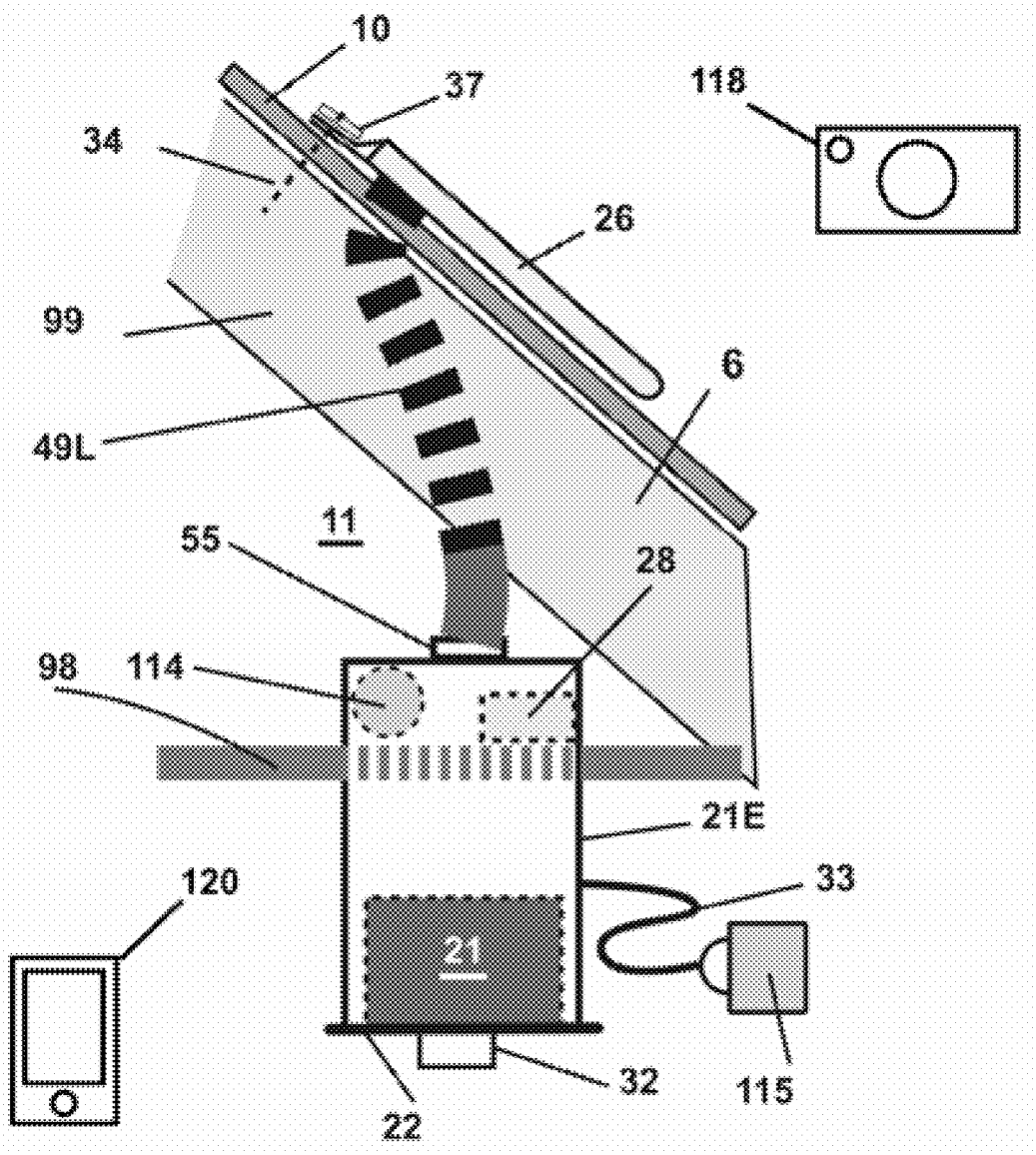
FIG. 28 is a cut-away view of a self-cleaning roof and gutter system with a blower, blower line, and controls.

FIG. 28 is a side view of blower enclosure 21E installed to soffit 98 of roof 10 in the area of eave 11. As shown, blower power cord 33 may be plugged into at least one of a smart plug or WiFi smart switch 115 to provide operation via the internet and cell phone with a cell phone app 120. If desired, a remote receiver plug tied to a remote switch can also be used. Blower enclosure 21E may also be equipped with a controller such as a PLC 28 to provide more control options such as stop and start, E-Stop (emergency stop), high pressure shut-off, camera on and off, as well as a switch to control the operation of cover 15 and/or top cover 15T individually or both at the same time, etc. Blower motor 21, which may be a fractional horsepower industrial vacuum cleaner motor which can develop a maximum pressure of up to 4 PSI gauge, must be limited and modified to produce a maximum pressure of no more than 2 PSI at the very end of the inflation cycle so as not to damage inflate membrane 26 with too much pressure. PLC 28 may also be equipped or programmed with a timer to automatically shut off blower 21 after a full cycle of inflation so that the blower does not overheat and possibly catch fire.

As shown, blower line 49L is connected to inflate membrane 26 from air exhaust fixture 55 secured to the top surface of blower enclosure 21E. By experiment, it has been found that the standard inflate membrane for a wide variety of applications requires between approximately 0 and 4 PSI to provide enough lifting force to lift and propel about 1500 pounds of ice and snow or more, per linear foot, from the gutter trough 53 and cover 15.

Also shown is another feature, high-pressure switch 114 electrically coupled to the blower 21 that can prevent the over pressurization of inflate membrane 26 at the very end of the inflation cycle, when the inflate membrane is fully inflated, by shutting blower 21 off immediately. Placement of the high-pressure switch (input hose) 114 is at the very end of inflate membrane 26 so that it will not be triggered prematurely, until the entire inflate membrane is inflated from end to end. For some applications, the inflate membrane 26 may require up to 80 inches of water or more (3 to 4 PSI) when heavy snow and ice formations build up on a roof. A phone app 120 can also report these kinds of conditions, so the user knows what going on, making the system more user friendly and safe. A camera 118, such as an outdoor Ring® camera, can be set up and operated via the internet for the user to watch and monitor the operation of cover 15.

Figure 29:
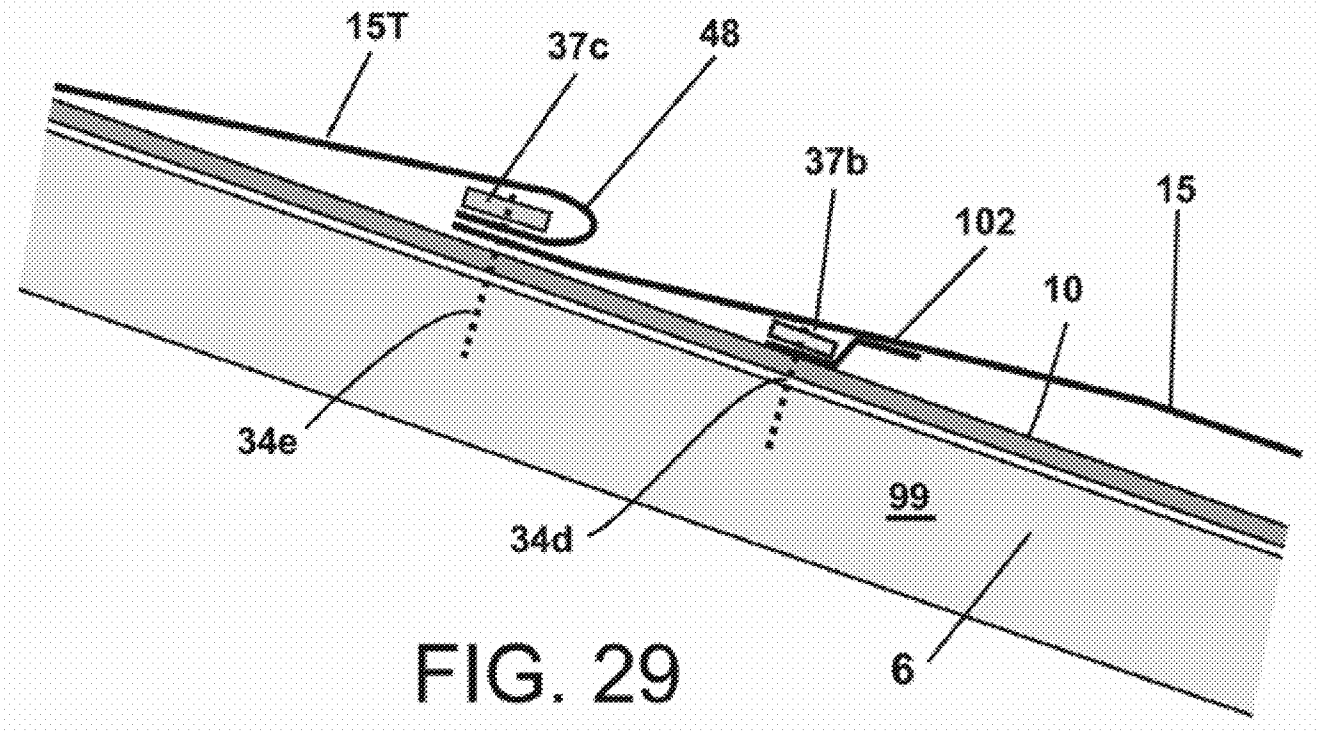
FIG. 29 is a cut-away view showing a flexible cover with a separate top cover.
Figure 30:
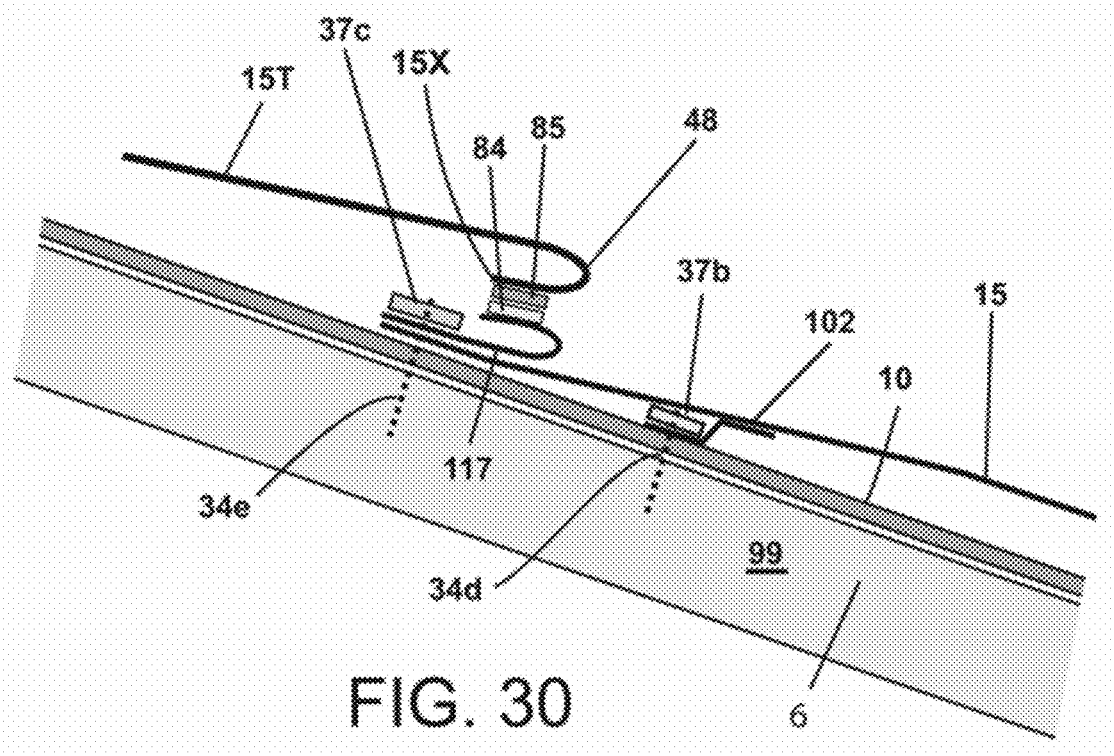
FIG. 30 is a cut-away view showing a flexible cover and top cover removably connected to a top cover connection flap.

FIGS. 29 and 30 are side views of cover 15 at the bottom of roof 6 being connected to top cover 15T for covering an area of the roof 6 and roof deck 10 uphill from the cover 15. As shown in FIG. 29, top end of bottom cover 15 is placed next to bottom end of top cover 15T and installed on roof 6 with deck 10 using clamp bar 37*c* and fastener 34*e*. To start, top cover 15T is pulled downward and aligned with bottom cover 15. Once clamp bar 37*c* is installed, then top cover 15T can be folded over and upward to create a watertight seam. Notice slack 48 is created on top cover to allow for the expansion that may take place if other inflate membranes 26 are used under top cover 15T. In FIG. 30, a more seasonal and temporary connection is possible by applying hook strip 84 to the underside of top cover connection flap 117 secured to clamp bar 37*c*. When top cover connection 117 is turned upside down, hook strip 84 can interface with and fasten to loop strip 85 secured to bottom end of top cover 15T. Hook strip 84 and loop strip 85 are components of a hook and loop fastener system. Notice that some slack 48 is maintained as part of top cover 15T. When top cover 15T is not in use (during the summer), top cover connection flap 117 is turned downward so hook strip 84 is protected from the sun and UV radiation. In addition to a hook and loop fastening system being used, zippers, buckles or any type of other edge to edge fastening system could also be used. Top cover 15T may have one or more small inflate membranes underneath it so that when inflate membranes 26 are inflate and deflated, movement is provided to cause snow on top to break free and slide downward. These smaller membranes 26 under top cover 15T may be operated via the primary blower 21 as the bottom inflate membrane 26 or by the use of a small auxiliary blower. The top cover 15T and bottom cover 15 may be operated individual to actually dispense snow and ice from the roof controllably in small increments rather than all of the snow at one like an avalanche.

While there have been described what are at present considered to be the preferred embodiments of this invention, it will be obvious to those skilled in the art that various changes and modifications may be made therein without departing from the invention and it is, therefore, aimed to cover all such changes and modifications as fall within the true spirit and scope of the invention.

I claim:

1. A self-cleaning gutter and roof system for controllably removing gutter contents from a roof at a time determined by an operator comprising:

a gutter frame (51) attachable to a roof deck (10) or roof shingles (52);

an inflatable inflate membrane (26) attachable to the roof deck (10) or shingles (52);

a flexible cover (15) attachable at a first end to the roof (10) uphill from the gutter frame (51) and sized to cover the inflate membrane (26) in both a deflated state and an inflated state, and at least a portion of the gutter frame (51), whereby the inflate membrane (26) in the deflated state causes gutter contents (7) to be controllably retained on the roof by the gutter frame (51), and the inflate membrane (26) in the inflated state causes the gutter contents to be controllably lifted upward and over an edge of the gutter frame (51), thereby controllably removing gutter contents from the roof (10).

2. The self-cleaning gutter and roof system of claim 1, the flexible cover (15) comprising a PVC-coated fabric, the PVC-coated fabric comprising an ultraviolet stabilizer.

3. The self-cleaning gutter and roof system of claim 2, the ultraviolet stabilizer comprising at least one of a benzotriazole, benzophenone, hindered amine light stabilizer, titanium dioxide, and carbon black.

4. The self-cleaning gutter and roof system of claim 1, the gutter frame (51) comprising:

a gutter frame mounting plate (51C) attachable to a roof deck (10) via fasteners (34*a*, 34*b*);

a gutter frame face (51D) securable to the gutter frame mounting plate (51C), thereby forming a gutter trough (53) between the gutter frame mounting plate and the gutter frame face; and a gutter frame top drip edge plate (51E) attachable on a top of the gutter frame face (51D).

5. The self-cleaning gutter and roof system of claim 4, further comprising a cover tab (102*a*) attachable over a top of the top drip edge plate (51E) and under the cover (15), the cover (15) comprising a bottom end (15X) attachable to a top surface of the gutter frame face (51D) such that the cover (15) can be installed by hanging the cover from the gutter frame (51) to provide access to the cover tab (102*a*), attaching the cover tab (102*a*) to the gutter frame (51), and then disposing the cover (15) over top drip edge plate (51E), gutter frame face (51D), and gutter frame mounting plate (51C), thereby keeping any water, ice, or snow away from the roof deck (10).

6. The self-cleaning gutter and roof system of claim 1, the gutter frame (51) comprising:

a structural angle or an L-shape forming a gutter trough (53) for containing gutter contents, the gutter frame made of steel, glass-reinforced plastic, or aluminum; and a wood cap (103) disposed on a top edge of the structural angle or L-shape.

7. The self-cleaning gutter and roof system of claim 1, the gutter frame (51) comprising:

a substantially U-shape;

a first leg of the U-shape attachable to a vertical fascia board (12) of an eave (11) of a roof (6) comprising the roof deck (10);

a second leg of the U-shape comprising a gutter frame peak (51Z) that is higher than the first leg of the U-shape and higher than a lowest end of the roof deck (10) for providing a brake action to gutter contents in a gutter trough (53) formed between the first leg and the second leg.

8. The self-cleaning gutter and roof system of claim 1, further comprising:

at least one cover tab (102*a*, 102*b*) secured to an underside of the cover (156) via respective heat seals (104*a*, 104*b*);

the cover (15) comprising a top end (15X) securable under a shingle (52).

9. The self-cleaning gutter and roof system of claim 1, the flexible cover (15) comprising:

a polyvinyl fluoride film laminated on a top surface;

polyvinylidene fluoride resin film laminated on a top surface;

polyester geomembrane fabric; or polyester roofing fabrics coated with ketone ethylene ester.

10. The self-cleaning gutter and roof system of claim 7, the inflate membrane (26) comprising:

an inflate membrane sealed edge (106) pneumatically sealing an end of the inflate membrane (26);

an inflate membrane tab (27);

an inflate member coupler (26X) attachable to an air supply to inflate the inflate membrane (26); and a pressure relief vent (92) installed on the inflate membrane (26) to limit a maximum pressure within.

11. The self-cleaning gutter and roof system of claim 1, the inflate membrane (26) further comprising:

a seam stitch (26C) to divide the inflate membrane into different compartments (26Da, 26Db); and a washer (107) and a fastener (108) at one end of the seam stitch to keep an area around the seam stitch (26C) from inflating and possibly rupturing.

12. The self-cleaning gutter and roof system of claim 1, the gutter frame (51) comprising a plurality of gutter frame sections (51*a*, 51*b*, 51*c*) attachable to a plurality of corresponding roof deck sections (10*a*, 10*b*, 10*c*) angled with respect to each other at a roof edge inward corner (95) or roof edge outward corner (94);

the inflate membrane (26) comprising a plurality inflate membrane sections (26*a*, 26*b*, 26*c*) corresponding to the gutter frame sections; the gutter system further comprising:

a respective transfer tube (91*a*, 91*b*) for pneumatically connecting respective adjacent inflate member sections;

a respective restriction collar (89*a*, 89*b*) corresponding to each transfer tube for placing over and around respective inflate member sections; and two respective restriction collar tabs (90*a*, 90*b*, 90*c*, 90*d*) corresponding to each transfer tube to hold the inflate membrane sections and transfer tubes in place.

13. The self-cleaning gutter and roof system of claim 12, the flexible cover (15) comprising a plurality of flexible cover sections (15*a*, 15*b*, 15*c*) corresponding to respective gutter frame sections; the gutter system further comprising:

a respective cover connector panel (96*a*, 96*b*) configured to join together adjacent respective flexible cover sections.

14. The self-cleaning gutter and roof system of claim 12, the flexible cover (15) comprising a plurality of flexible cover sections (15*a*, 15*b*, 15*c*) corresponding to respective gutter frame sections; the gutter system further comprising:

a respective substantially square corner panel (96Xa, 96Xb) configured to join together adjacent respective flexible cover sections.

15. The self-cleaning gutter and roof system of claim 1, further comprising:

an end panel (26P) attached to a lateral end of the flexible cover (15) for keeping rain, water, snow, dust, and other elements from an area between the roof deck (10) and under the cover (15);

a first fastener (9) affixed to the end panel (26P);

a bungee cord (54) attached at a first end to the first fastener (9); and a second fastener (101) for anchoring to the roof deck (10) and attaching a second end of the bungee cord (54), whereby the bungee cord is configured to allow the cover (15) to expand outward during inflation and the end panel (26P) to be pulled back and inside the cover (15) during deflation.

16. The self-cleaning gutter and roof system of claim 1, further comprising:

a top cover (15T) for covering an area of the roof deck (10) uphill from the cover (15); and a clamp bar (37*c*) for installing the top cover (15T) and flexible cover (15) onto the roof deck (10) with a fastener, whereby the top cover (15T) and flexible cover (15) can be installed by first aligning a bottom edge of the top cover (15T) with a top edge of the flexible cover (15), fastening the clamp bar (37*c*) to the roof deck (10) at the aligned edges, and folding the top cover (15T) over and upward to create a watertight seam.

17. The self-cleaning gutter and roof system of claim 16, the inflate membrane (26) comprising another inflate membrane disposed under top cover (15T) for dispensing snow and ice from a roof controllably in increments.

18. The self-cleaning gutter and roof system of claim 1, further comprising:

a top cover (15T) for covering an area of the roof deck (10) uphill from the cover (15), the top cover having a bottom edge;

a first portion (85) of an edge-to-edge fastening system secured to a bottom end side of the top cover (15T);

a second portion (84) of the edge-to-edge fastening system;

a top cover connection flap (117), the second portion (84) secured to an end of the top cover connection flap (117); and a clamp bar (37*c*) for installing the top cover (15T) and top cover connection flap (117) onto the roof deck (10) with a fastener, whereby the top cover (15T), connection flap (117), and flexible cover (15) can be installed to the roof (10) by first aligning a bottom edge of the top cover connection flap (117) with a top edge of the flexible cover (15), fastening the clamp bar (37*c*) to the roof deck (10) at the aligned edges, removably attaching the first portion (85) to the second portion (84), and folding the top cover (15T) over and upward.

19. The self-cleaning gutter and roof system of claim 18, the edge-to-edge fastening system comprising: a hook strip (84) and loop strip (85) of a hook and loop fastening system, zippers, or buckles.

20. The self-cleaning gutter and roof system of claim 18, the inflate membrane (26) comprising another inflate membrane disposed under top cover (15T) for dispensing snow and ice from a roof controllably in increments.

21. The self-cleaning gutter and roof system of claim 1, further comprising:

a blower enclosure (21E) installable through an enclosure opening (116) of a roof soffit (98); the blower enclosure (21E) comprising:

a blower intake/exhaust (32); and an air exhaust fixture (55);

a blower (21) disposed inside the blower enclosure (21E); and a blower line (49L) pneumatically connecting the air exhaust fixture (55) to the inflate membrane (26).

22. The self-cleaning gutter and roof system of claim 21, the blower comprising a fractional horsepower vacuum cleaner motor capable of developing a maximum pressure of approximately 4 PSI gauge.

23. The self-cleaning gutter and roof system of claim 21, further comprising:

a high-pressure switch (114) electrically coupled with the blower (21) to prevent over pressurization of the one or more inflate membranes (26); and a controller (28) programmed to limit pressure generated by the blower (21) to a maximum of approximately 4 PSI gauge.

24. The self-cleaning gutter and roof system of claim 23, the controller (28) comprising a PLC configured to automatically control the at least one of the operations of stop, start, emergency stop, high pressure shut-off, camera on and off, and individually or together control two or more of the inflate membranes (26).

25. The self-cleaning gutter and roof system of claim 22, further comprising:

a blower power cord (33); and at least one of a smart plug, a WiFi smart switch (115) configured for operation via an internet and/or cell phone via a cell phone app, and a remote receiver plug tied to a remote switch.

26. A self-cleaning gutter and roof system for controllably removing gutter contents from a roof at a time determined by an operator comprising:

a gutter frame (51) attachable to a roof deck (10) or roof shingles (52);

an inflatable inflate membrane (26) attachable to the roof deck (10) or shingles (52);

a flexible cover (15) attachable at a first end to the roof (10) uphill from the gutter frame (51) and sized to cover the inflate membrane (26) in both a deflated state and an inflated state, and at least a portion of the gutter frame (51);

a blower (21) pneumatically connected to the inflate membrane;

a camera (118) for viewing operation of the self-cleaning gutter system;

a controller (28) in operative communication with the blower; and a phone app installable on a smart phone (120) programmed to remotely operate the controller (28) and remotely operate the camera;

such that an operator using the phone app can view the self-cleaning gutter and roof system with the camera, observe the inflate membrane (26) in the deflated state that causes gutter contents (7) to be controllably retained on the roof by the gutter frame (51) and remotely control the controller and blower with the phone app to inflate the inflate membrane (26) such that the inflate membrane (26) in the inflated state causes the gutter contents to be controllably lifted upward and over an edge of the gutter frame (51).

* * * * *